US006942525B2

(12) United States Patent
Olson et al.

(10) Patent No.: US 6,942,525 B2
(45) Date of Patent: Sep. 13, 2005

(54) PLUG

(75) Inventors: Stanley W. Olson, East Berlin, PA (US); David F. Fusselman, Middletown, PA (US); Rudolphus G. T. M. Gerritsen, Wijchen (NL)

(73) Assignee: FCI Americas Technology, Inc., Reno, NV (US)

( * ) Notice: Subject to any disclaimer, the term of this patent is extended or adjusted under 35 U.S.C. 154(b) by 3 days.

(21) Appl. No.: 10/391,388

(22) Filed: Mar. 18, 2003

(65) Prior Publication Data

US 2004/0009684 A1 Jan. 15, 2004

Related U.S. Application Data

(60) Provisional application No. 60/383,366, filed on May 24, 2002, and provisional application No. 60/383,490, filed on May 24, 2002.

(51) Int. Cl.[7] ..... H01R 24/00; H01R 33/00

(52) U.S. Cl. ..... 439/660

(58) Field of Search ..... 439/405, 660, 439/607, 609

(56) References Cited

U.S. PATENT DOCUMENTS

| | | | | | |
|---|---|---|---|---|---|
| 3,710,303 | A | * | 1/1973 | Gallager, Jr. | 439/593 |
| 5,118,306 | A | * | 6/1992 | Bixler et al. | 439/405 |
| 5,490,033 | A | * | 2/1996 | Cronin | 361/212 |
| 5,785,557 | A | | 7/1998 | Davis | 439/660 |
| 5,931,687 | A | | 8/1999 | McFarlane et al. | 439/79 |
| 5,947,754 | A | | 9/1999 | Lin | 439/79 |
| 5,951,306 | A | | 9/1999 | Millhimes | 439/79 |
| 5,980,337 | A | * | 11/1999 | Little | 439/857 |
| 6,106,338 | A | | 8/2000 | Wu et al. | 49/660 |
| 6,270,379 | B1 | | 8/2001 | Huang et al. | 439/660 |
| 2003/0186580 | A1 | * | 10/2003 | Dambach et al. | 439/497 |

OTHER PUBLICATIONS

U.S. Appl. No. 60/379,353, filed May 10, 2002.
U.S. Appl. No. 60/383,366, Olson, filed May 24, 2002.
U.S. Appl. No. 60/383,403, Sercu, filed May 24, 2002.
U.S. Appl. No. 60/383,940, Simpson, filed May 24, 2002.

* cited by examiner

*Primary Examiner*—Chandrika Prasad
(74) *Attorney, Agent, or Firm*—Woodcock Washburn LLP

(57) ABSTRACT

A plug comprises a plug housing having a body and a plurality of beams extending therefrom and forming gaps therebetween. A member bridges the gaps between the beams at their distal ends. Ground contacts comprising a body, an elongated contact portion, and armatures are inserted into the plug housing. A recess formed in the distal end of the elongated contact portion engages the member. The ground contacts have projections extending therefrom that are disposed in channels formed through the body and along the beams. Signal contacts having a portion with a first form factor and a portion with a second form factor are also inserted into the plug housing. The portion with a first form factor extends through a conduit in the plug housing body and along a trough formed in the beams. The distal ends of the signal contacts have recesses formed in their distal ends with projections from the beams situated therein. The portion of the signal contact with a second form factor abuts the housing body.

23 Claims, 35 Drawing Sheets

PLUG

CROSS REFERENCE TO RELATED APPLICATIONS

This application claims the benefit of U.S. Provisional Patent Application 60/383,366 filed May 24, 2002 and entitled "Improved Receptacle," and U.S. Provisional Application 60/383,490 filed on May 24, 2002 and entitled "Improved Plug," the contents of which are hereby incorporated by reference in their entirety.

This application is related by subject matter to U.S. patent application Ser. No. 10/391,387 filed on Mar. 18, 2003 and entitled "Improved Receptacle," U.S. Patent Application 60/383,403 filed on May 24, 2002 and entitled "Paddle-Card Termination for Shielded Cable," and U.S. Patent Application 60/379,353 filed on May 10, 2002 and entitled "Overmolded Strain Relief and Electrical," the contents of which are hereby incorporated by reference in their entirety.

FIELD OF THE INVENTION

The present invention relates to electrical connectors and more particularly to plugs and receptacles.

BACKGROUND

The speed and capacity of computing systems is constantly on the rise. Furthermore, computing systems are being interconnected in increasingly complex networks. In order to keep pace with these developments, new interconnect systems such as, for example, the InfiniBand architecture have been proposed. The InfiniBand architecture is an industry standard, channel-based, switched fabric, interconnect architecture, with a primary application in the area of server interconnection. InfiniBand promises to provide reliable interconnect performance at speeds ranging from 2.5 to 30 Gbits/second.

The InfiniBand standard, and others like it such as, for example, 10 Gbit Ethernet represent notable advances in interconnect speeds. At the lofty speeds provided by these technologies, the highest levels of electrical performance are required of the physical interconnect devices. For example, creating a stable contact interface with precise impedance matching is essential. Likewise, electromagnetic interference and leakage must be minimized. Furthermore, these characteristics must be provided in a physical form that is mechanically operable in real world situations and capable of being manufactured consistently in large quantities.

SUMMARY

Disclosed herein are improved interconnect systems. More particularly, disclosed herein are improved plugs.

A disclosed exemplary plug comprises a plug housing with signal contacts and ground contacts inserted therein. The plug housing comprises a body with a plurality of beams extending therefrom with gaps formed therebetween. A nose member bridges the gaps between the beams at their distal ends.

Ground contacts are inserted through the plug housing body and into the gaps formed between the beams. The ground contacts comprise a body, an elongated contact member extending therefrom, and a pair of armatures extending from the body opposite the elongated contact member. The armatures have portions formed therein that are aligned with edges of the contact body and may be used to apply pressure to insert the contact into the plug housing. The elongated contact members have recesses formed therein at their distal ends that engage the nose member when the contacts are inserted into the plug housing. The ground contacts further comprise projections extending therefrom that are disposed in channels formed through the housing body and along the housing beams.

Signal contacts are inserted through conduits formed in the plug housing body and along troughs formed in the plug housing beams. A first portion of each signal contact has a first form factor and a second portion of each signal contacts has a second form factor. The form factor of the conduits through the plug housing body is larger than that of the first portion; accordingly, the first portion of the signal contacts can be inserted through the housing body and along the beams. However, the form factor of the conduits is smaller than the second portion of the signal contacts. Accordingly, the second portion cannot be inserted through the conduits, but rather forms an interference fit with the conduit opening. The distal ends of the signal contacts have recesses formed therein into which projections from the plug housing beams extend.

BRIEF DESCRIPTION OF THE DRAWINGS

An exemplary plug is described with reference to the accompanying drawings in which.

DETAILED DESCRIPTION OF ILLUSTRATIVE EMBODIMENTS

An exemplary plug and receptacle with the above-mentioned beneficial features are described below with reference to FIGS. 1 through 28. In particular, novel aspects of an exemplary plug are described in detail below. The description given herein with respect to the Figures is for illustrative purposes only and is not intended in any way to limit the scope of the potential embodiments. Questions regarding the scope of the potential embodiments may be resolved by referring to the appended claims.

Figure 1:
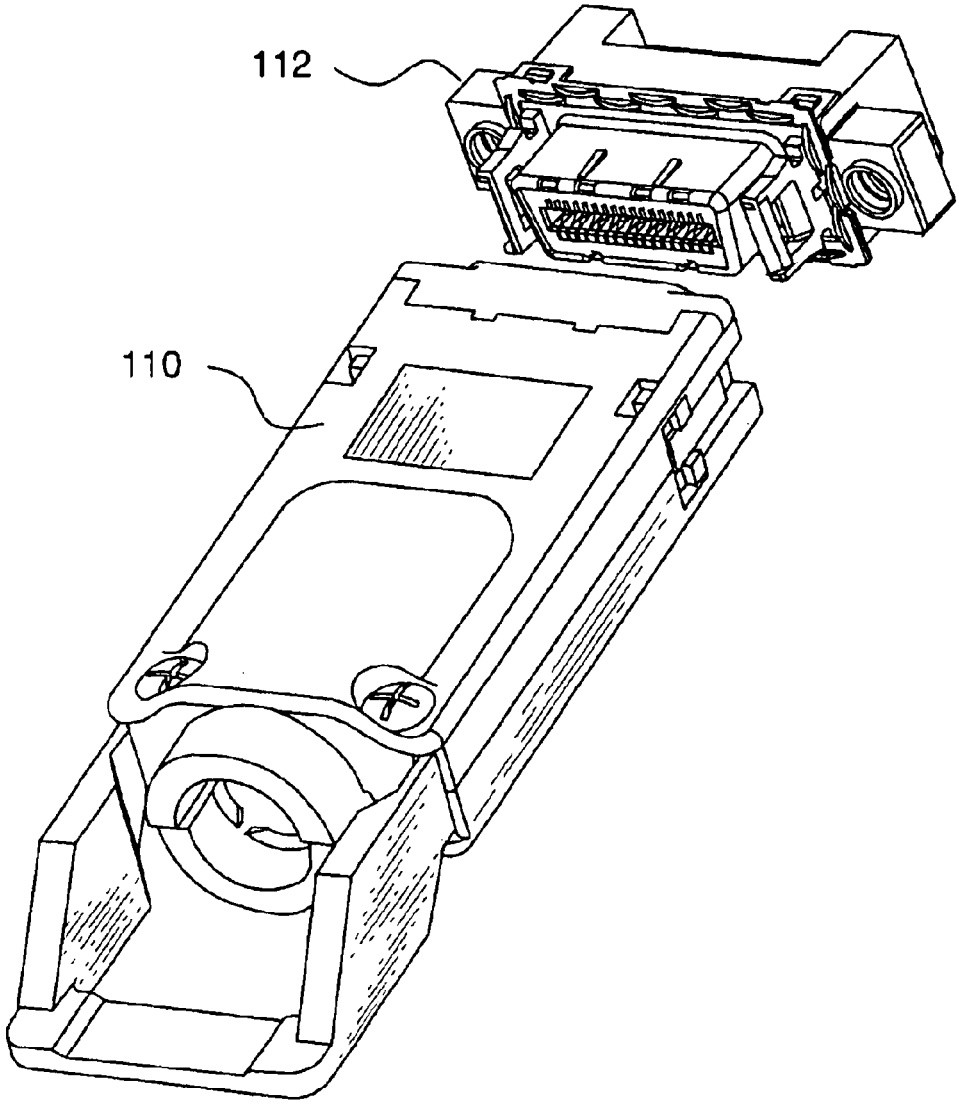
FIG. 1 is a perspective view of an exemplary plug aligned for interconnection with an exemplary receptacle.
Figure 2:
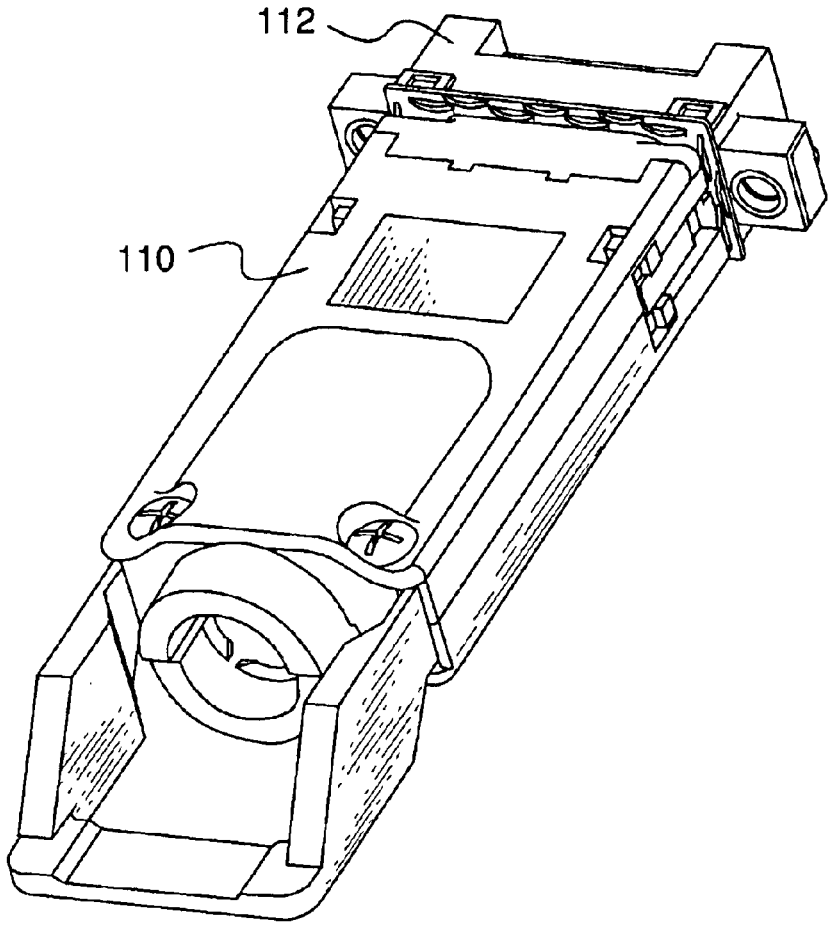
FIG. 2 is a perspective view of an exemplary plug interconnected with an exemplary receptacle.

FIG. 1 provides a perspective view of exemplary plug 110 aligned for interconnection with exemplary receptacle 112. Plug 110 serves as the terminating point for a plurality of wires incorporated in a cable (not shown). Receptacle 112 provides electrical connectivity to a device such as, for example, a printed circuit board. Plug 110 is inserted into receptacle 112 as shown in FIG. 2 so as to provide a communication path from plug 110 to the device to which receptacle 112 is connected.

Figure 3:
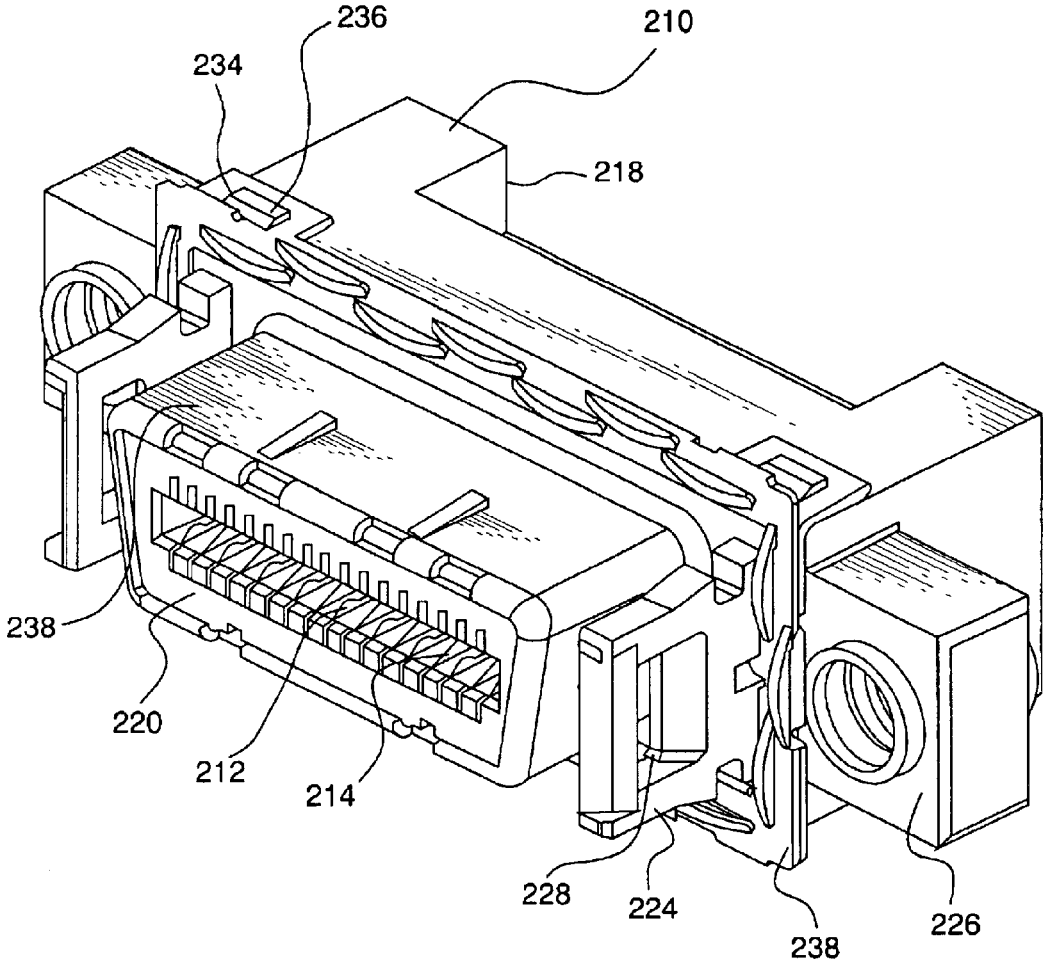
FIG. 3 is a front perspective view of an exemplary receptacle.
Figure 4:
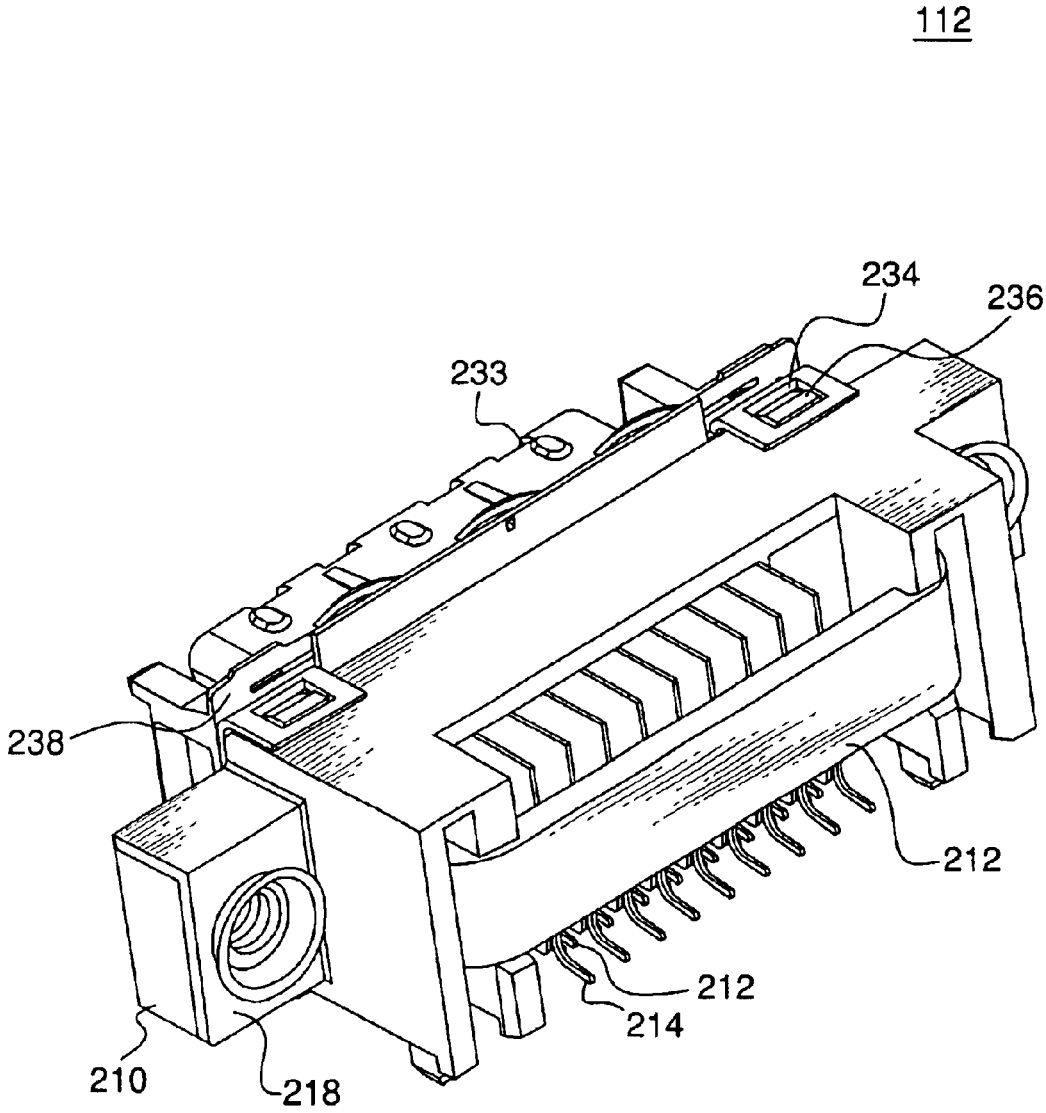
FIG. 4 is a rear perspective view of an exemplary receptacle.
Figure 5:
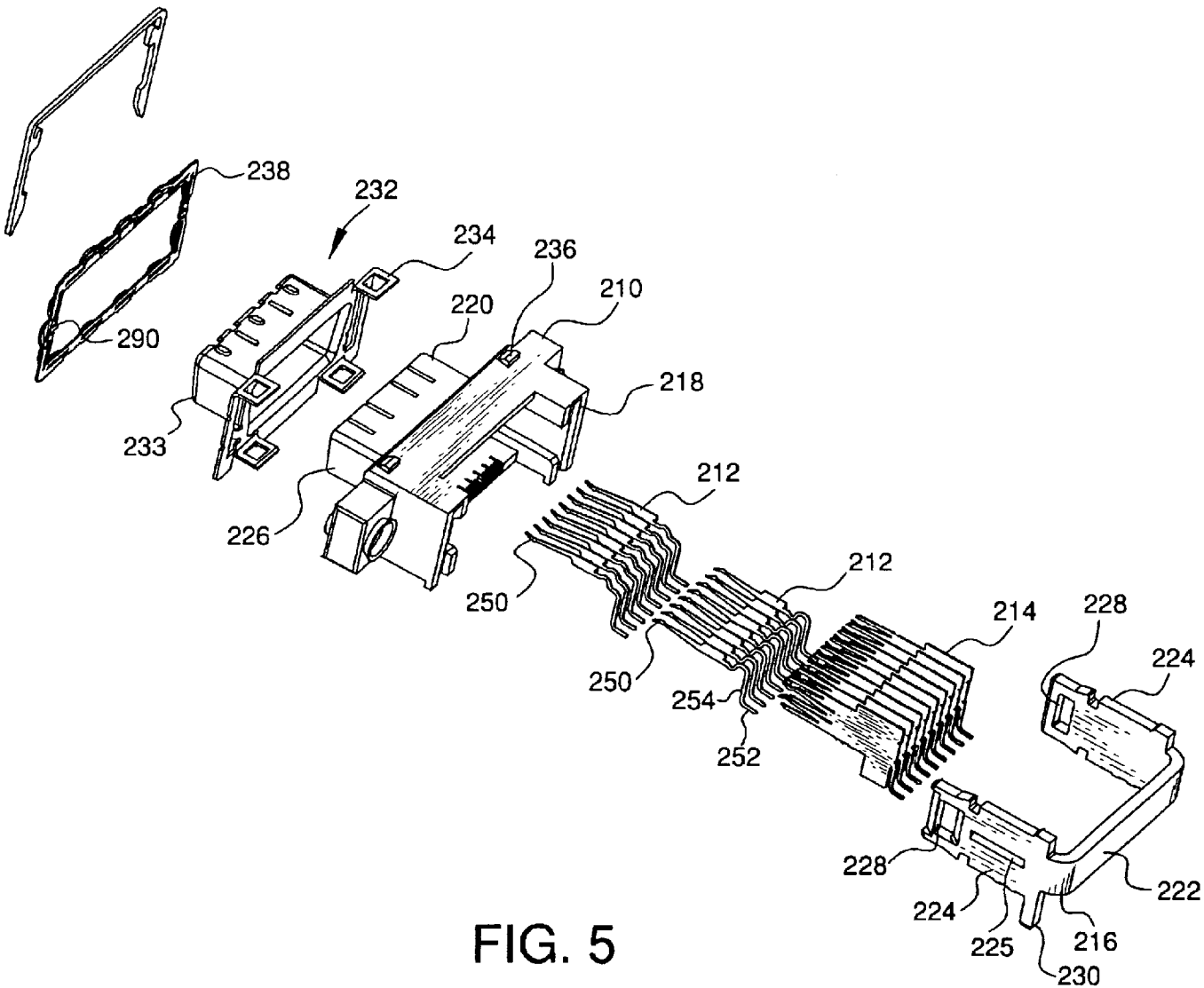
FIG. 5 is an exploded view of an exemplary receptacle.

Front, rear, and exploded views of receptacle 112 are provided in FIGS. 3, 4, and 5 respectively. As shown, receptacle 112 comprises receptacle housing 210 into which signal contacts 212, ground contacts 214, and latch plate 216 are inserted. Metallic signal contacts 212 and ground contacts 214 extend from rear side 218 of housing 210 into plug interface 220 portion of receptacle housing 212 and are secured in place by frictional coupling. Plug interface portion 220 has an area therein at which contacts 212 and 214 are exposed for the purpose of mating with corresponding contacts in plug 110. Receptacle housing 210 is manufactured from a high temperature thermo-plastic material such as, for example, liquid crystal polymer (LCP), and is operable to provide electrical isolation between contacts 212.

Latch plate 216 comprises latch bar 222 and latch members 224 extending therefrom. Latch members 224 extend through housing 210 and project from external side 226. Recesses 228 are formed in latch members 224 and are designed to receive corresponding latches 421 from plug assembly 210. Latch members 224 have channels 225 formed in their exterior surfaces for interacting with locking members 290 extending from electrical gasket 238. Latch plate 216, and in particular latch bar 222 extends across the rear of receptacle housing 210 and protects contacts 212 and 214 from unintentional manipulation. Generally, latch plate 216 is formed of a high strength conductive metal that can be soldered such as, for example, cold rolled steel (CRS), and further comprises grounding projections 230 for connecting to a ground contact on a device such as a printed circuit board.

Shielding shell 232 is formed to correspond to the exterior surface of plug interface portion 220 and is fitted thereto. Specifically, shell 232 comprises casing 233, which encapsulates the surface of interface portion 220. Receptacles 234 are formed in shell 232 and correspond to projections 236 formed in housing 210. Receptacles 234 frictionally interact with projections 236 to maintain shell 232 in position on plug interface portion 220. Shielding shell 232 is manufactured from a conductive material that is capable of being extruded such as, for example, cold rolled steel. Upon connection of plug 110 to receptacle 112, shielding shell 232 contacts the metallic casing of plug 110 and thereby reduces electromagnetic interference (EMI).

Gasket 238 fits around casing 233 of shielding shell 232. Gasket 238 is manufactured from a conductive material with spring characteristics such as, for example, phosphorous bronze, and has metal beams extending therefrom. When plug 110 is inserted into receptacle 112, the metal beams extending from gasket 238 overlap the casing of plug 110. Gasket 238 thereby operates to reduce electromagnetic forces (EMF's) escaping between plug 110 and receptacle 112 and maintains an equal ground potential between plug 110 and receptacle 112.

Signal contacts 212 comprises a plug contact portion 250 for making electrical contact with a corresponding contact in plug 110 and a tail portion 252 for electrically connecting receptacle 112 to a device such as a printed circuit board. Pivot member 254 is formed between the two. Tail portions 252 should be precisely aligned so as to facilitate connecting receptacle 112 to a device. Given the extremely delicate nature of contacts 212, maintaining the alignment of tail portions 252 throughout manufacturing and up until connection to an electrical device is a difficult proposition. Receptacle housing 210 disclosed herein is especially designed to maintain the desired alignment of tail portions 252.

Figure 6:
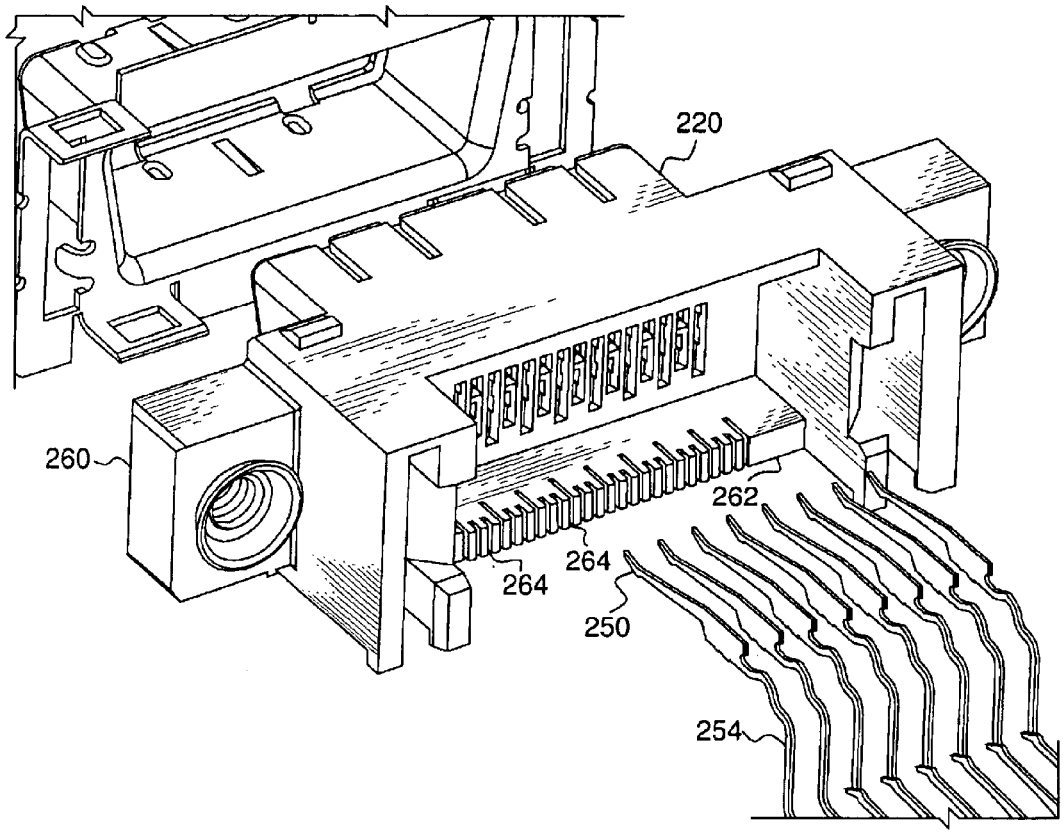
FIG. 6 is a rear view of an exemplary receptacle housing.
Figure 7A:
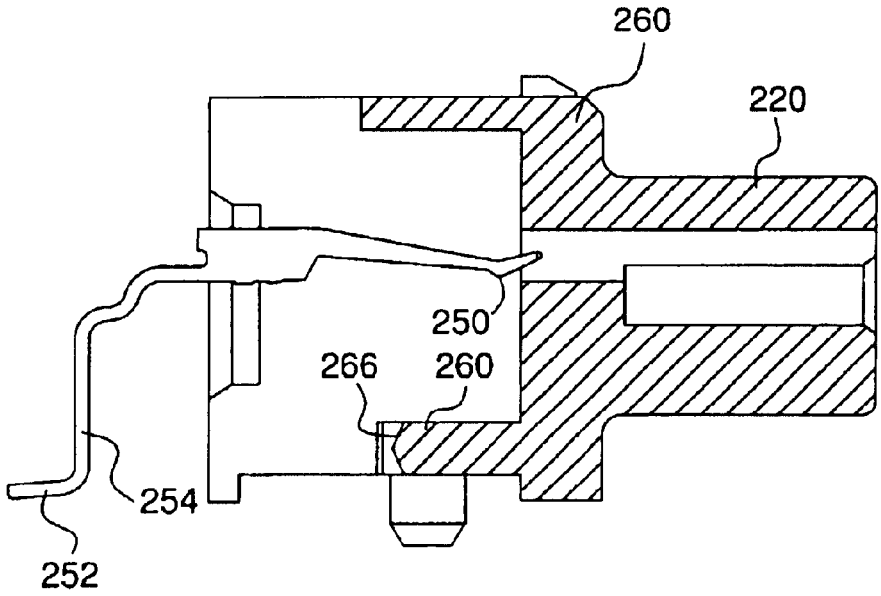
FIGS. 7A through 7D illustrate a signal contact at various stages of insertion into an exemplary receptacle housing.
Figure 7B:
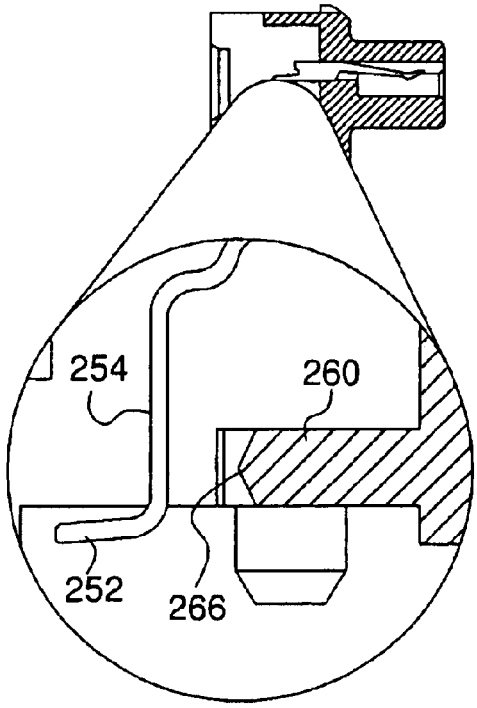
Figure 7C:
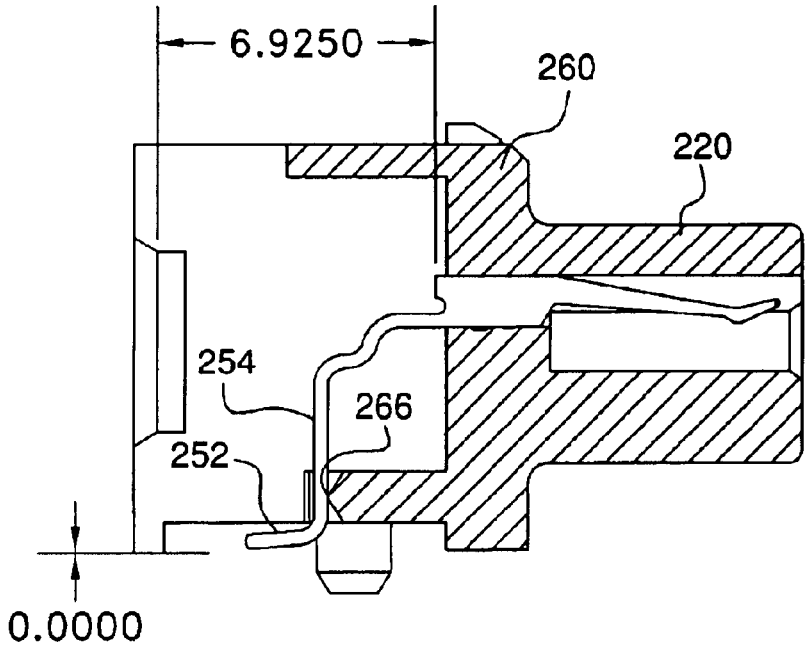
Figure 7D:
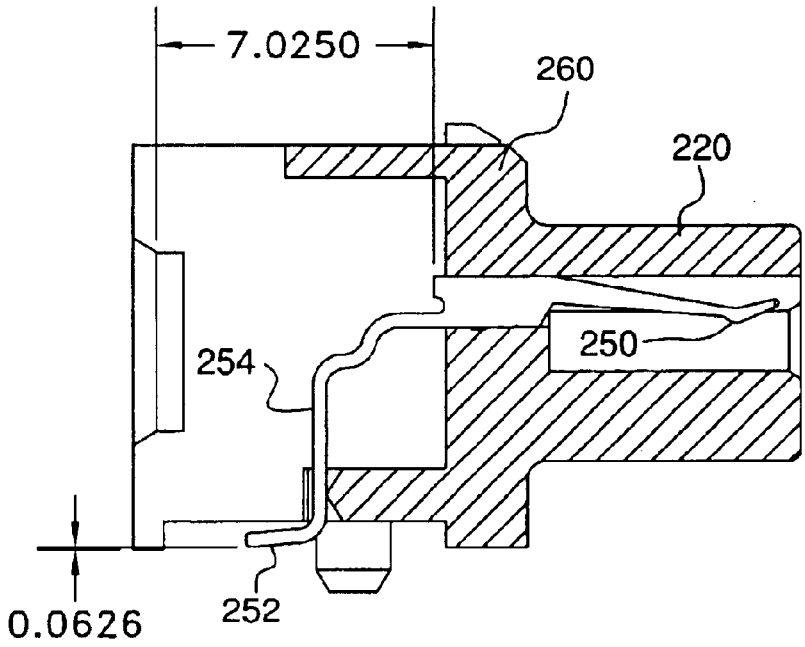
Figure 8:
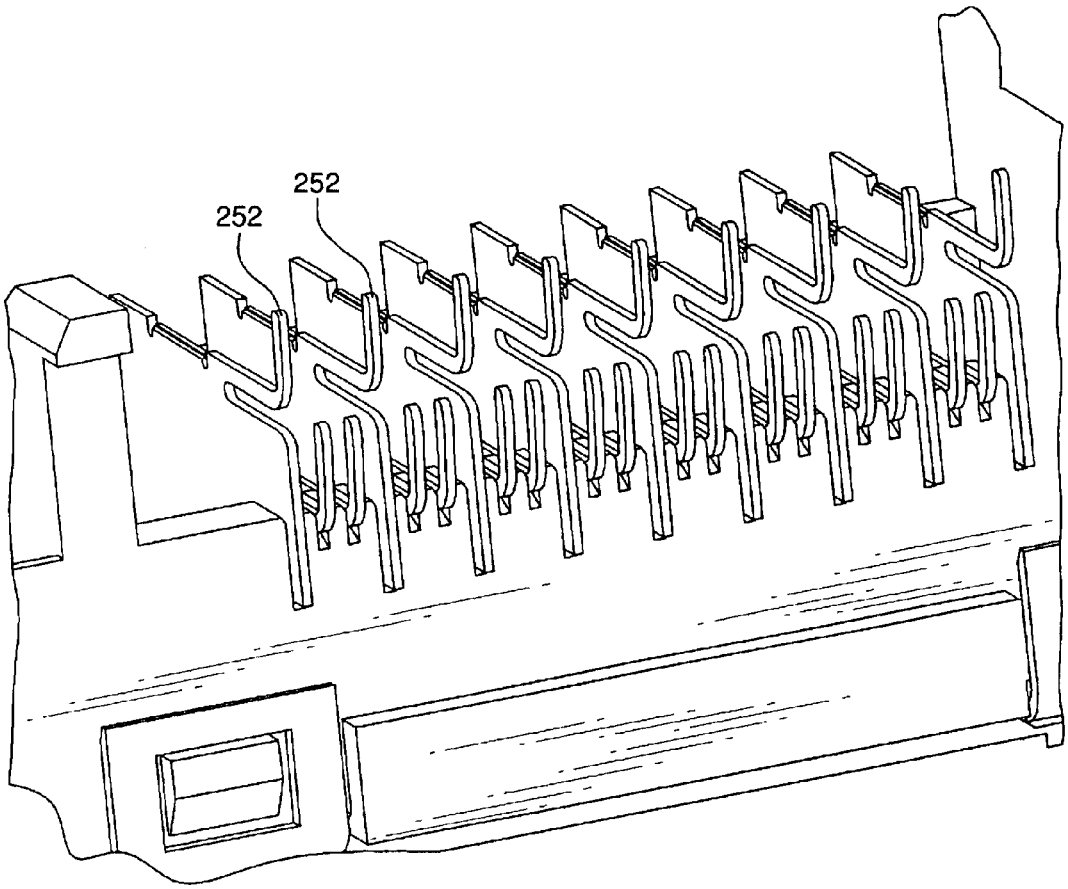
FIG. 8 is a diagram illustrating the bottom rear of an assembled exemplary receptacle.

As shown in FIG. 6, receptacle housing 210 comprises a body 260 with interface portion 220 extending therefrom. Contact support member 262 extends from body 260 and is separated from interface portion 220 by body 260. Contact support member 262 has a plurality of contact slots 264 or walled-cavities formed at edge 266 for receiving a portion of contacts 212 and 214. The contact slots 264 that receive signal contacts 212, receive therein pivot member 254 of signals contacts 212. FIGS. 7A through 7D provide a sectional view of housing 210 with a signal contact 212 at various stages of insertion into housing 210. As shown, within slot 264, support alignment member 262 has formed therein a fulcrum or pivot point 266. At pivot point 266 support alignment member 262 forms a generally acute angle. When signal contact 212 is fully inserted into housing 210, pivot member 254 abuts pivot point 266, which may cause tail portion 252 to be urged upward. Thus, pivot point 266 operates to define the horizontal as well as vertical positioning of tail portion 252. Pivot points 266 are formed in a plurality of slots 264 that receive signal contacts 212. As shown in FIG. 8, upon insertion of a plurality of signal contacts 212 into housing 210, tail portions 252 are urged into horizontal and vertical alignment.

Figure 9:
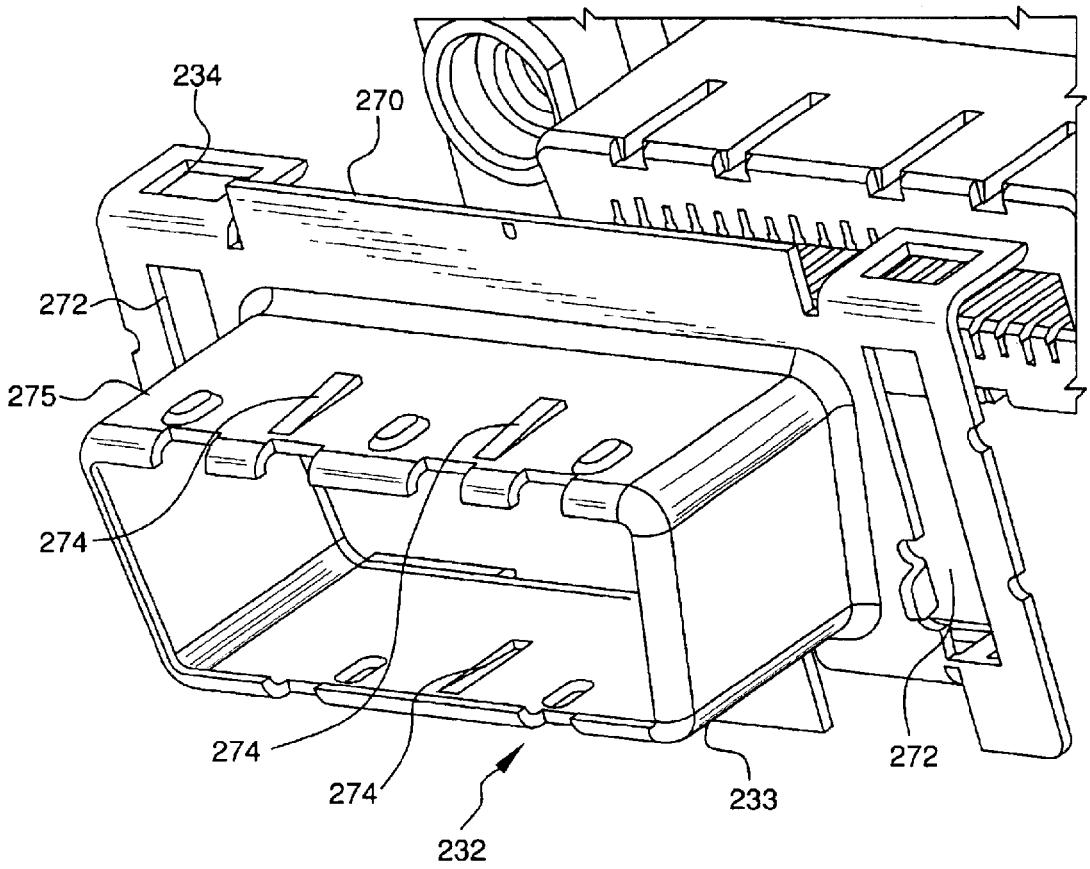
FIG. 9 is a detailed illustration of an exemplary shielding shell.

FIG. 9 provides a detailed view of shielding shell 232. As shown, shielding shell 232 comprises casing 233, which is specially formed to fit to the exterior of interface portion 220 of housing 210. Shell 232 further comprises upstanding walls 270 that are integrally formed with casing 233 and which abut exterior side 226 of housing 210 upon assembly. Shell 232 has recesses 272 formed therein to accommodate latch members 224.

Shielding shell 232 shields contacts 212 and 214 from EMI and prevents EMF leakage when receptacle 112 receives plug 110. These functions are best served when there is electrical continuity between receptacle 112 and plug 110. Accordingly, it is desirable to maintain a consistent and strong electrical contact between shielding shell 232 and the casing of plug 110. Casing 233 has outwardly projections 274 formed therein to facilitate this consistent electrical contact. In the disclosed embodiment, projections 274 have the form of cantilever beams. The height of projections 274 from the exterior surface of casing 233 increases along the length of projections 274. Increasing the height across the length of the projections 274 maintains physical contact and electrical continuity between shell 232 and the casing of plug 110 through tolerance extremes and mating conditions. As shown, projections 274 are formed on opposing sides of casing 233.

Figure 10:
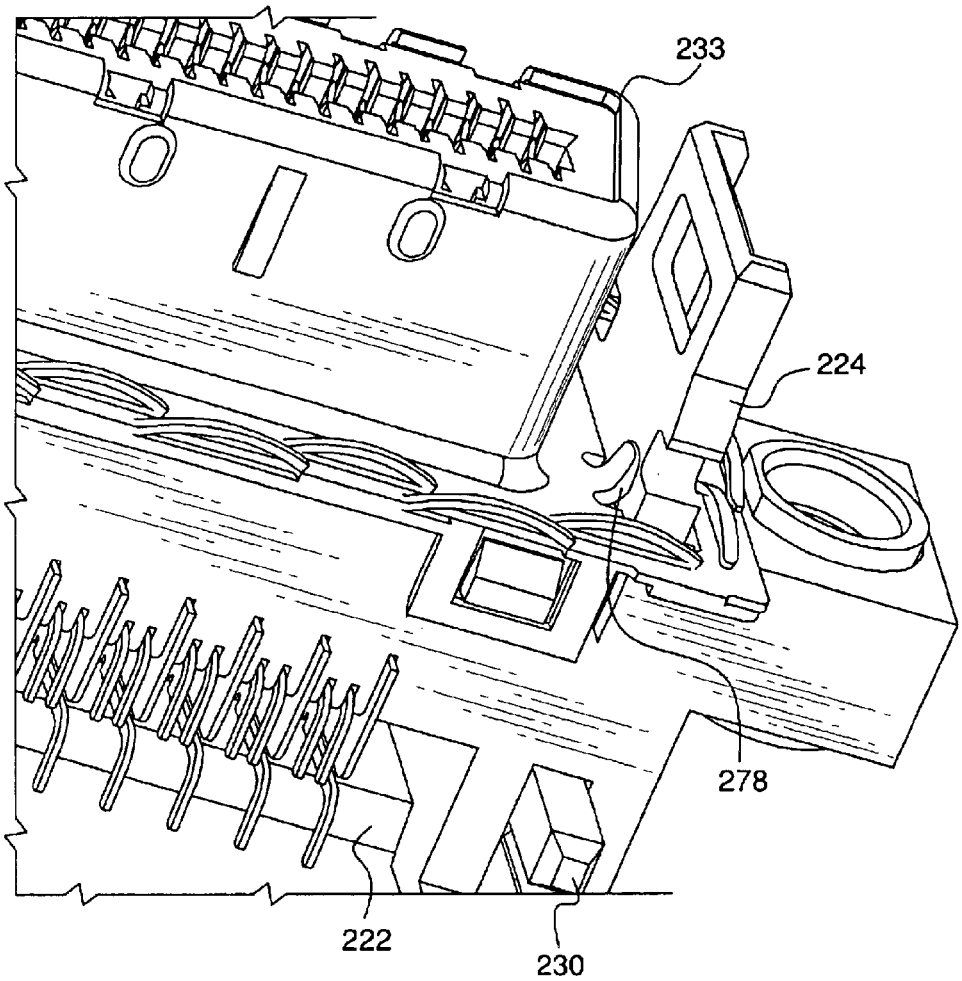
FIG. 10 is a front perspective view of an exemplary shielding shell contacting a latch member.

Shielding shell 232 further comprises projection 278. As shown in FIG. 10, upon assembly of receptacle 112, projection 278 contacts latch member 224. As noted above, latch member 224 is comprised in latch plate 216, which further comprises grounding projections 230. Accordingly, contact between projection 178 and latch member 224 provides an electrical path to ground through grounding projections 230. Indeed, electrical connectivity is provided from the casing of plug 110, through shell 232 and latch plate 216, to ground. This continuous electrical contact with the casing of plug 110, through receptacle 112 to ground maintains essentially the same ground potential between plug 110 and receptacle 112, which greatly improves performance.

Figure 11:
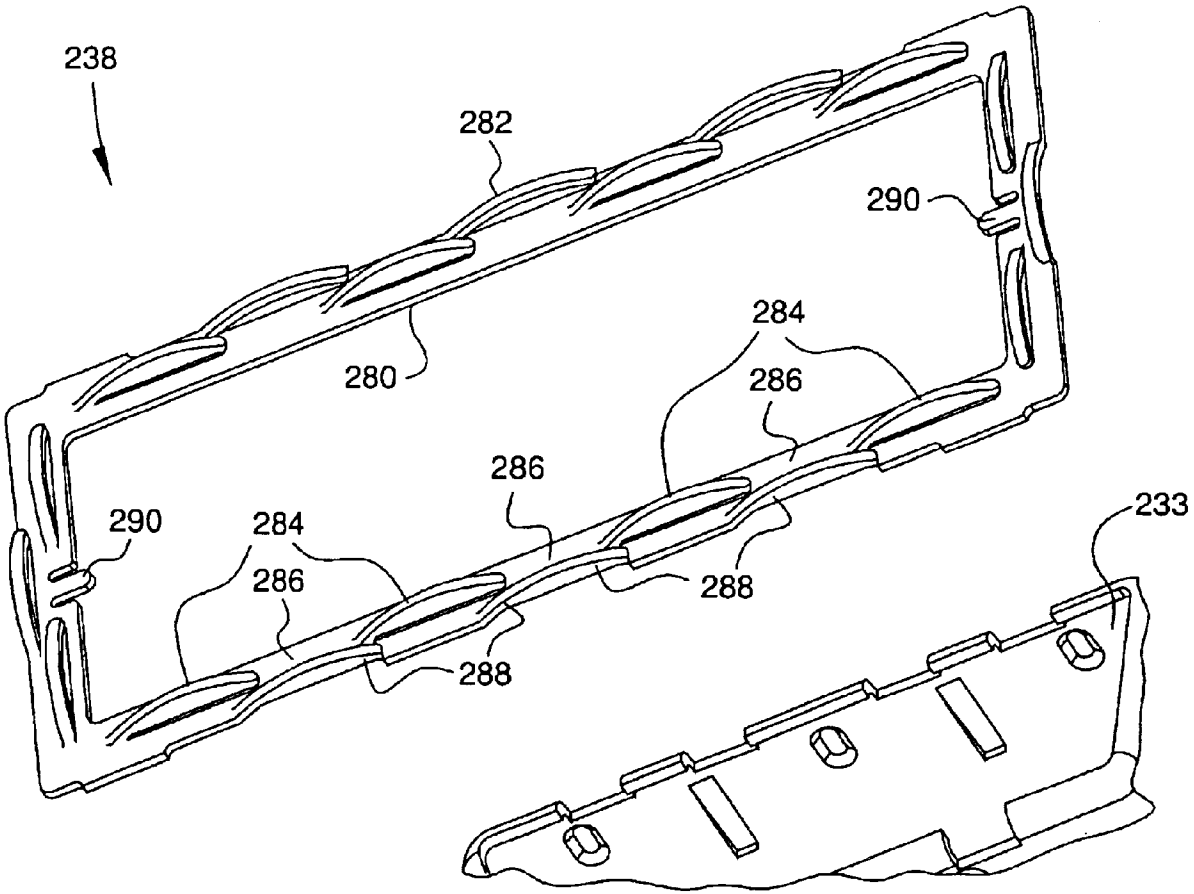
FIG. 11 is a perspective view of an exemplary electrical shielding gasket.
Figure 12:
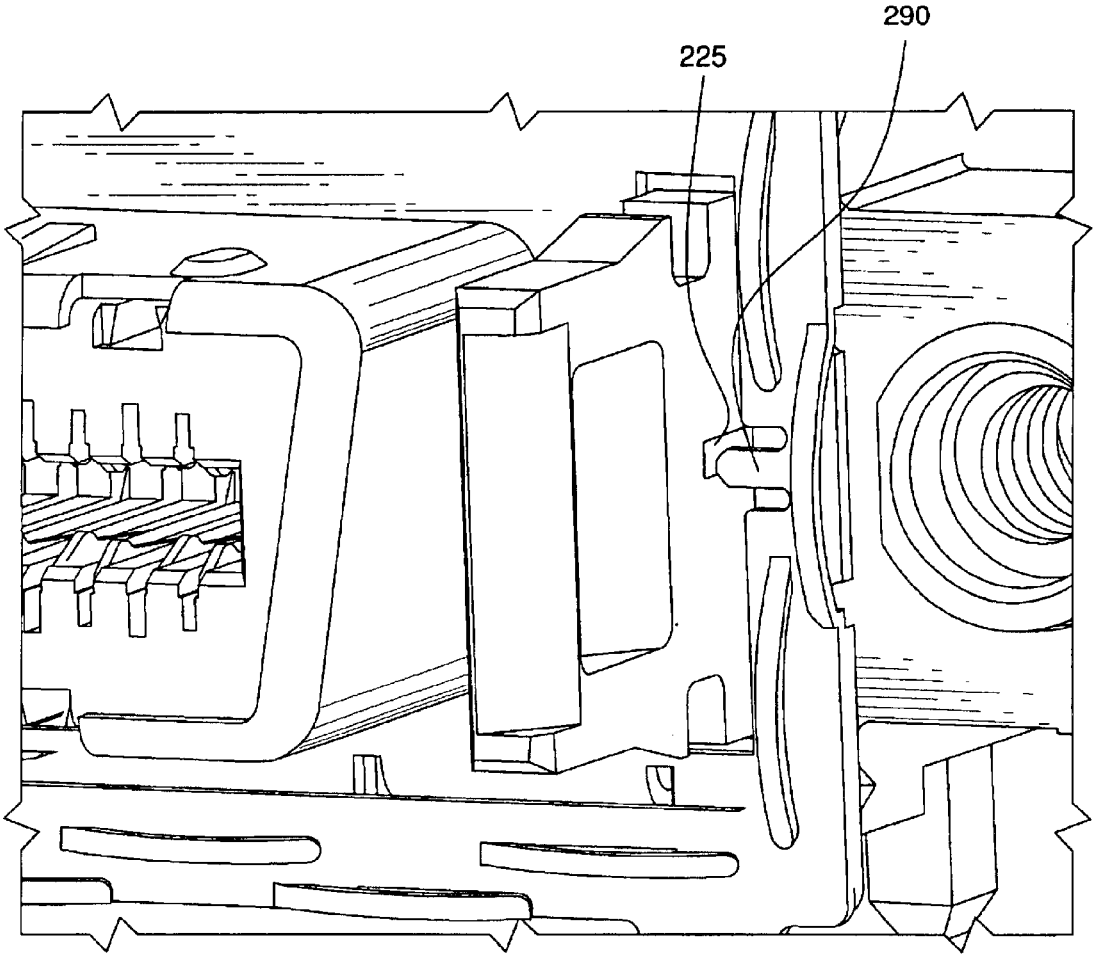
FIG. 12 is a front detailed view of an assembled exemplary receptacle illustrating the interaction of an electrical shielding gasket and a recess in a latch member.

A detailed view of electrical gasket 238 is provided in FIGS. 11 and 12. As shown, gasket 238 comprises frame 280, which is formed to be positioned around casing 233 of shell 232. Frame 280 has a plurality of arcuate metallic beams 282 extending therefrom around the perimeter of frame 280. Beams 282 extend from frame 280 in a generally arc-like shape and return to frame 280. Beams 282 may be formed, for example, by stamping of the gasket frame 280. A first plurality 284 of beams 282 is aligned linearly along frame 280 with portions 286 of frame 280 disposed in-between. A second plurality 288 of beams 282 is formed next to the first plurality 284. Beams 282 in the second plurality 288 overlap beams 282 in the first plurality 284 and thereby span portions 286 between beams in the first plurality 284. When gasket 238 is applied to receptacle 112 and plug 110 connected thereto, is positioned proximate any gap between plug 110 and receptacle 112 and overlapping beams 282 minimize the escape paths for electromagnetic forces (EMF's) between the two devices.

Gasket 238 further comprises locking members 290 for restricting movement of gasket 238 on the assembled receptacle 112. Locking member 290 extends away from frame 280 and, when assembled onto receptacle 112, into channels 225 formed in latch members 224. Locking member 290 resides in channel 225 and is limited in its freedom of movement by the length of channel 225.

Figure 13:
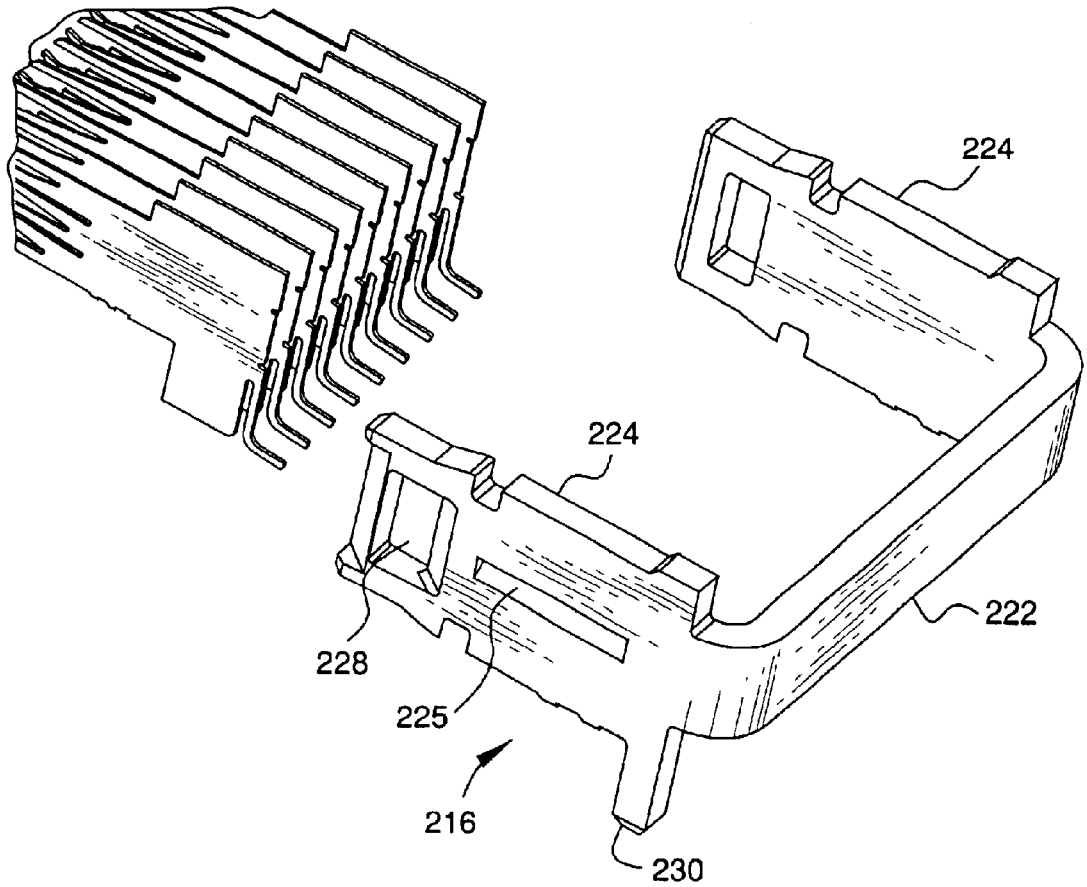
FIG. 13 is an isolated view of an exemplary latch plate.
Figure 14:
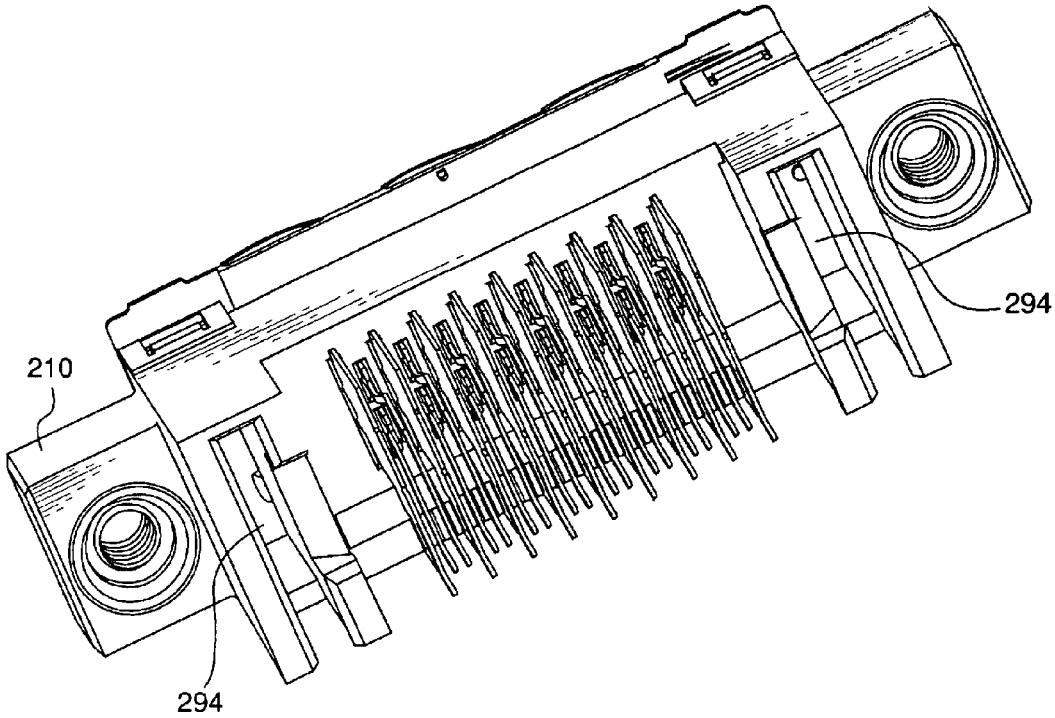
FIG. 14 is a rear view of an exemplary receptacle housing without a latch plate attached thereto.

FIG. 13 provides a detailed view of latch plate 216. As shown, latch plate 216 comprises latch bar 222 with latch members 224 extending therefrom. Latch members 224 may be inserted into latch member openings 294 formed in housing 210 (see FIG. 14) and extend from external side 226 of housing 210. Recesses 228 formed in latch members 224 receive corresponding latch members from plug 110 and operate to secure the two device halves together. Latch bar 222 operates to provide protection to contacts 212 and 214 and counterbalances the weight of housing 210 when the components assembled into receptacle 112. Latch plate 216 has grounding projections 230 formed therein which are designed to contact a ground source on the device to which receptacle 112 is attached. For example, grounding projections 232 may contact a ground located on a printed circuit board. Finally, channels 225 are formed in the exterior walls of latch members 224 and receive locking members 290.

Plug

Figure 15:
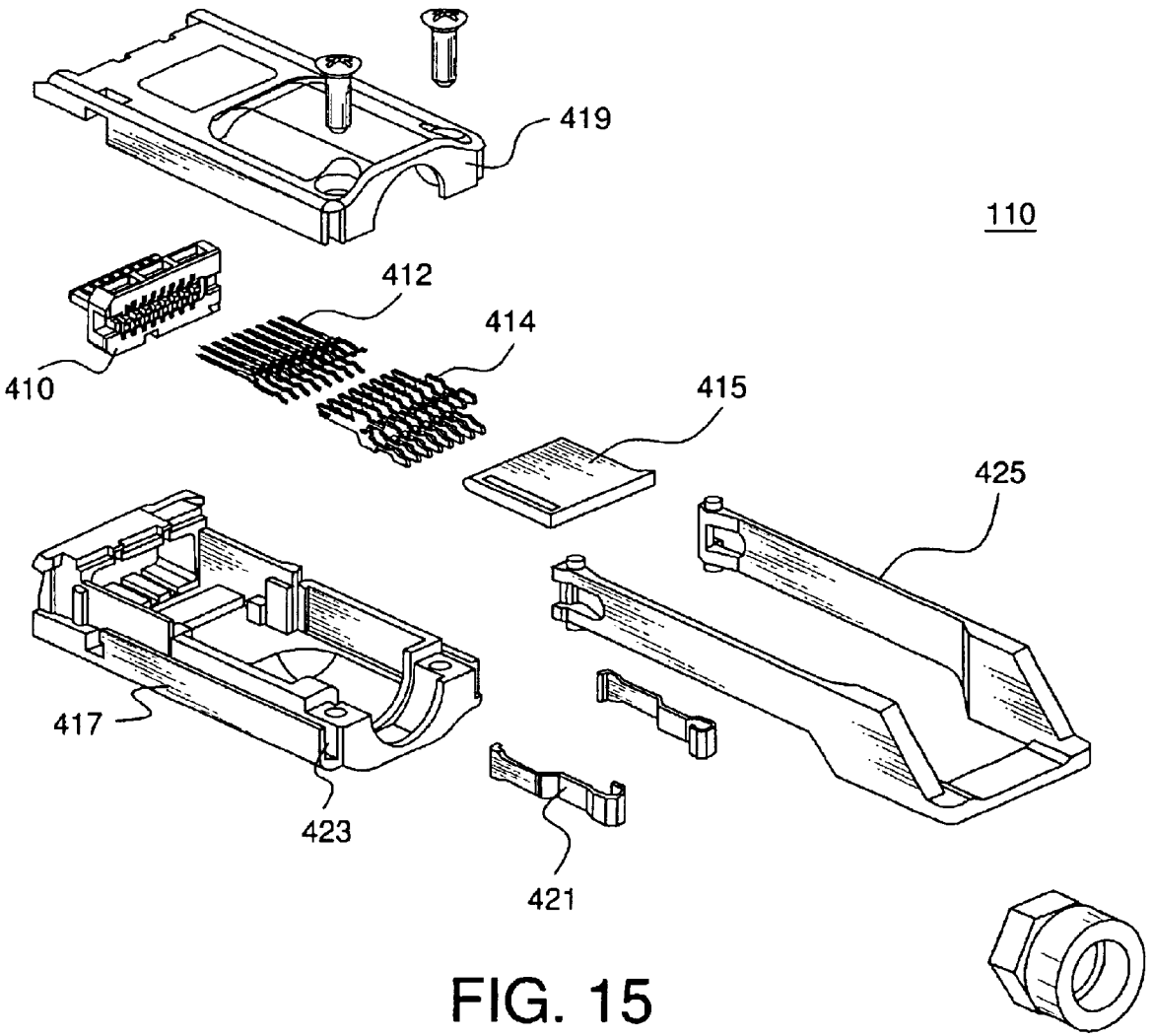
FIG. 15 is a perspective view of an exploded exemplary plug.

FIG. 15 provides an exploded view of plug 110. As shown, plug 110 comprises plug housing 410 into which signal contacts 412 and ground contacts 414 are inserted. Contacts 412 and 414 interface with printed circuit board 415 which has signal wires attached thereto (not shown) and which extend from plug 110 in a cable (not shown). Plug housing 410 with contacts 412 and 414 therein and circuit board 415 attached thereto are encapsulated in lower casing half 417 and upper casing half 419. Latches 421 reside in recesses 423 in casing halves 417 and 419 and interlock with latch members 224 of plug 112. Lanyard 425 is connected to latches 421 and is operable to control the latching position of latches 421.

Figure 16:
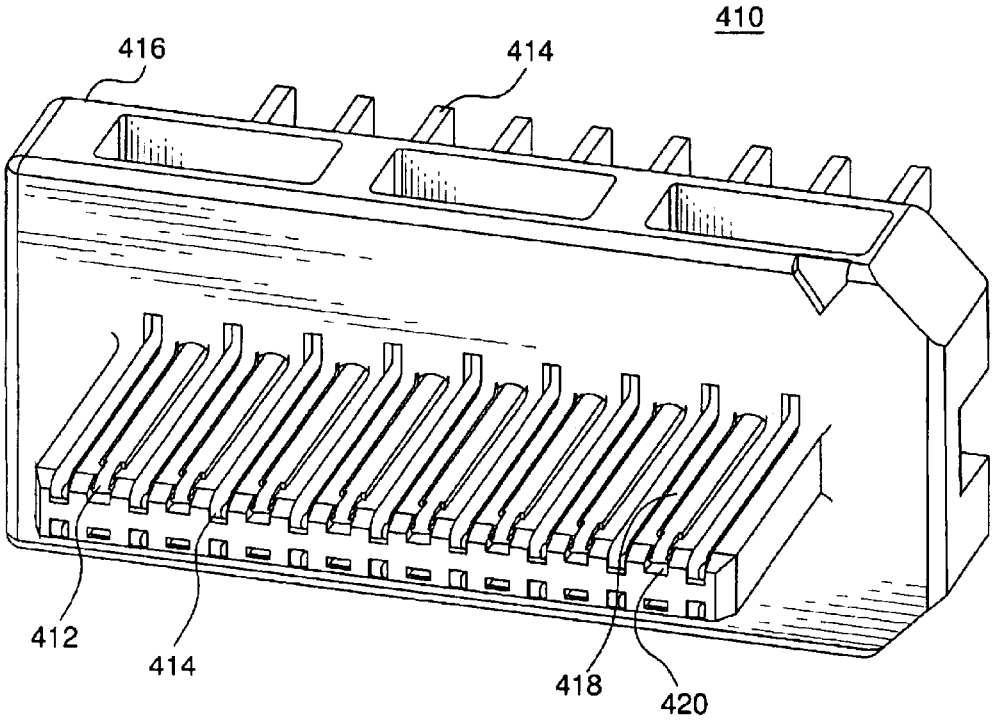
FIG. 16 is a front perspective view of an exemplary plug housing with contacts therein.
Figure 17A:
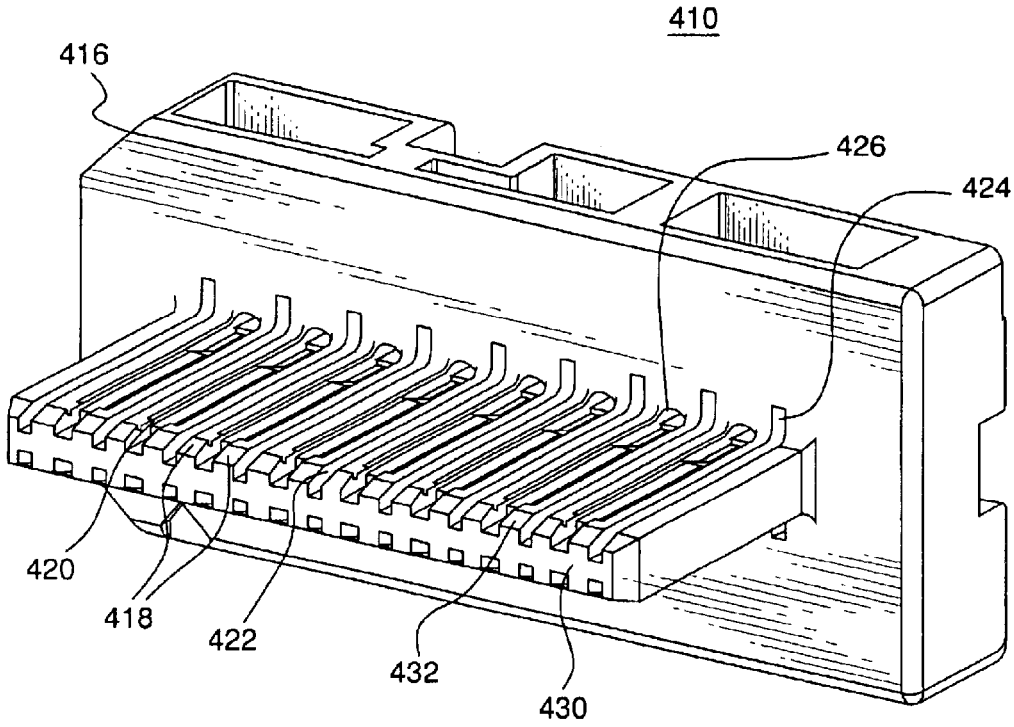
FIG. 17A is a front perspective view of an exemplary plug housing with contacts removed.
Figure 17B:
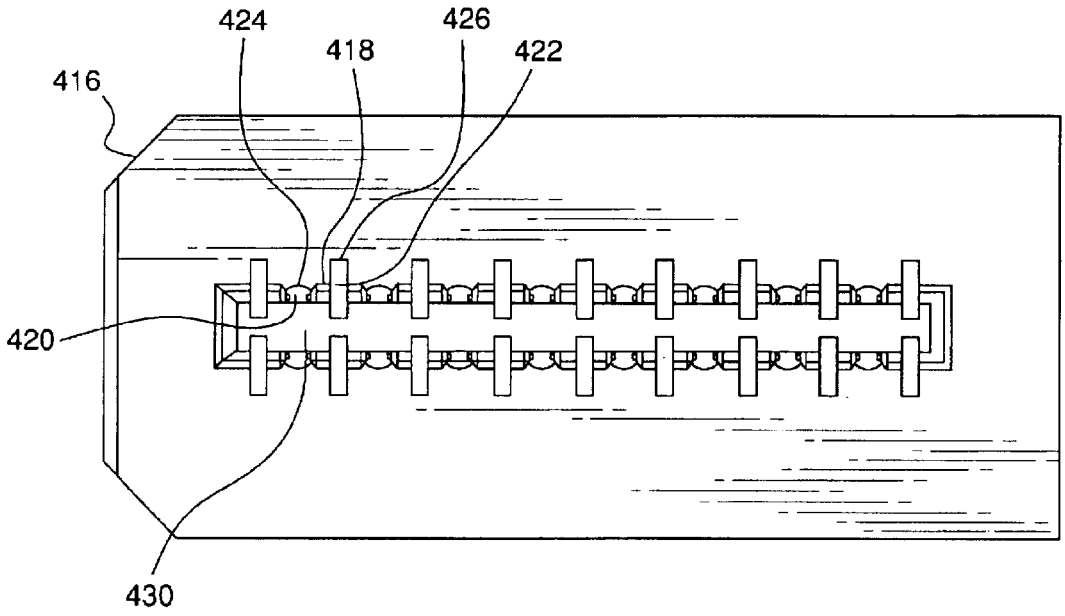
FIG. 17B is a front view of the exemplary housing with contacts removed.

FIG. 16 provides an isolated view of plug housing 410 with signal contacts 412 and ground contacts 414 formed therein. FIG. 17A provides a perspective view, and FIG. 17B provides a front view of housing 410 without contacts 412 and 414. As shown, housing 410 comprises a body portion 416 which has a plurality of projections or beams 418 extending therefrom. Beams 418 have troughs 420 formed therein with gaps 422 formed between beams 418. Body 416 has a plurality of conduits 424 formed therein aligning with troughs 420. Signal contacts 412 extend through conduits and in troughs 420. Body also has a second plurality of conduits 426 formed therein that align with gaps 422 formed between beams 422. Ground contacts 414 extend through conduits 426 and into gaps 422. Housing 410 further comprises nose member 430 that bridges the gaps between beams 418 near their distal ends 432.

Figure 18:
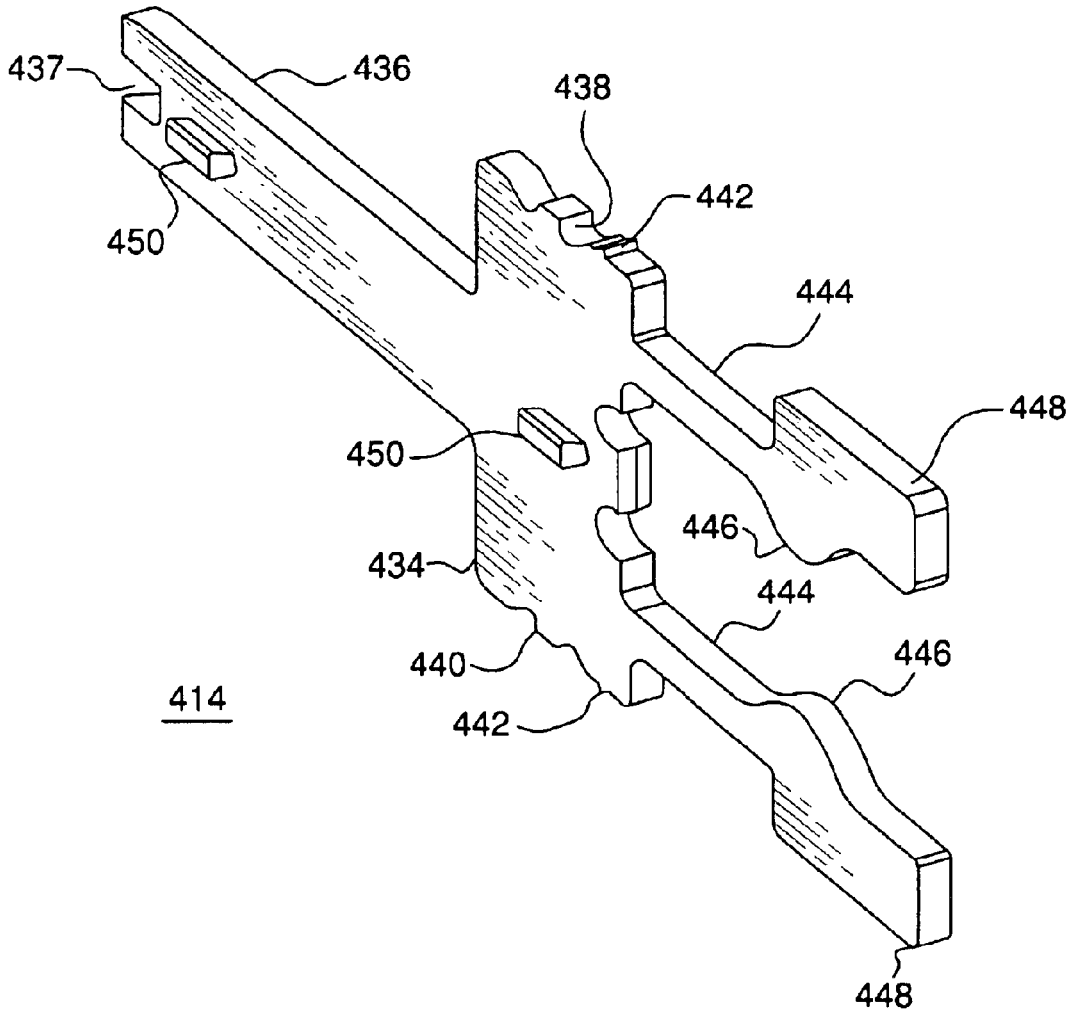
FIG. 18 is an isolated view of an exemplary ground contact for use in an exemplary plug housing.

FIG. 18 provides an isolated view of grounding contact 414. As shown, grounding contact comprises body 434 with an elongated contact area 436 extending therefrom. Elongated contact area 436 has notch or recess 437 formed therein for securing the distal end as described below. Grounding contact body 434 has a first surface 438 and a second surface 440 fitted with barbs 442 to enhance interference fit with housing 410. Ground contact 414 further comprises armatures 444 that extend from body 434 and are separated from contact area 436 by body 434. Armatures 444 have contact areas 446 formed therein for forming an electrical contact with printed circuit board 415. Armatures 444 further have formed therein tool application area 448. In the disclosed embodiment, tool application areas 448 comprise two surfaces formed at right angles and are suitable for application of a tool for inserting contact 414 into housing 410. A portion of tool application areas 448 substantially align with surfaces 438 and 440 and provide a suitable leverage point for applying pressure, with for example, a tool, to insert contact 414 into housing 410. Contact 414 further comprises projections 450 extending from the sides of elongated contact area 436 and body 434. As described in detail below, in the assembled plug housing 410, projections 450 reside in channels formed in the plug housing body 416 and beams 418.

Figure 19:
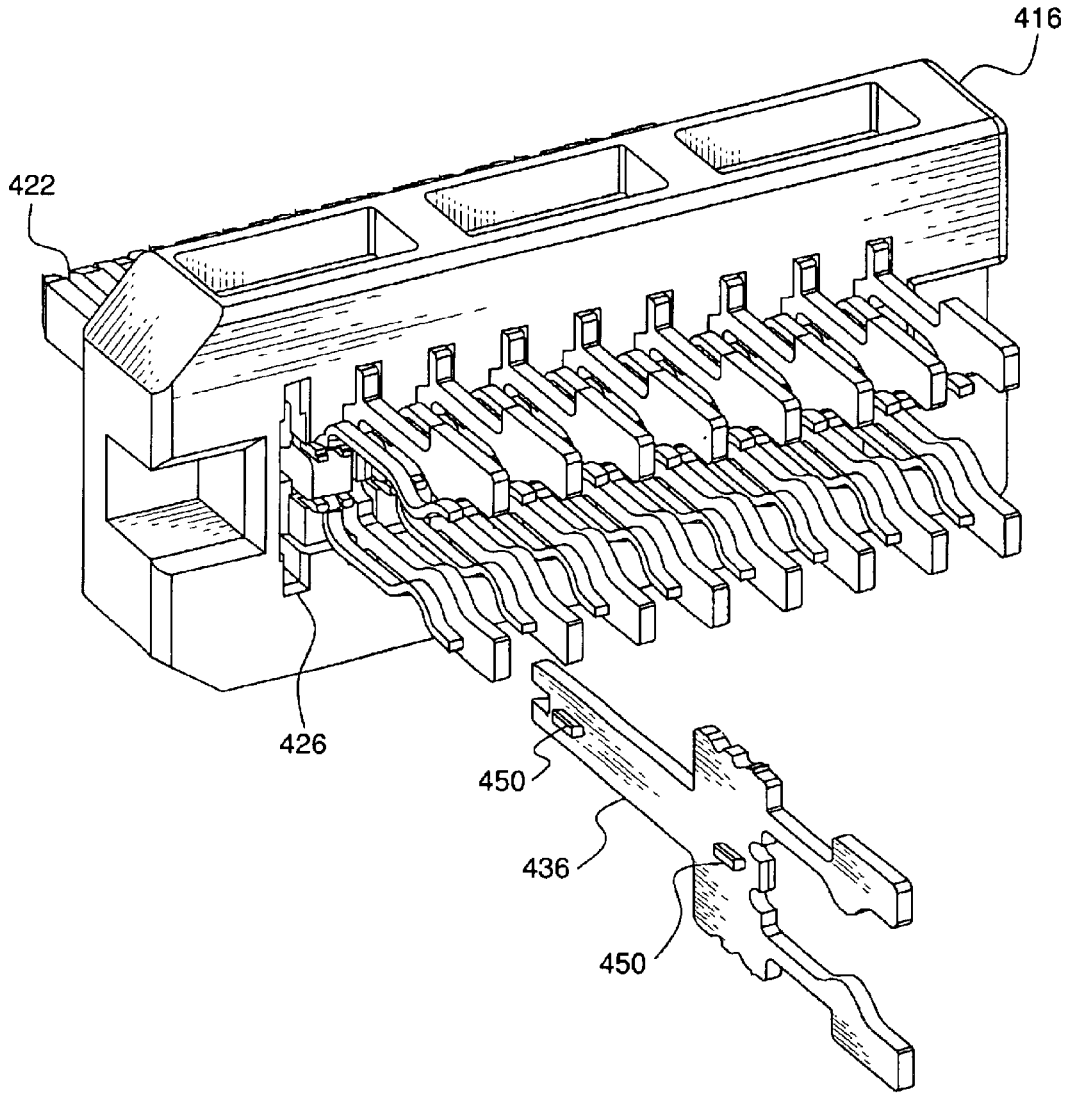
FIG. 19 is a perspective rear view of an exemplary plug housing with an exemplary ground contact aligned for insertion.
Figure 20:
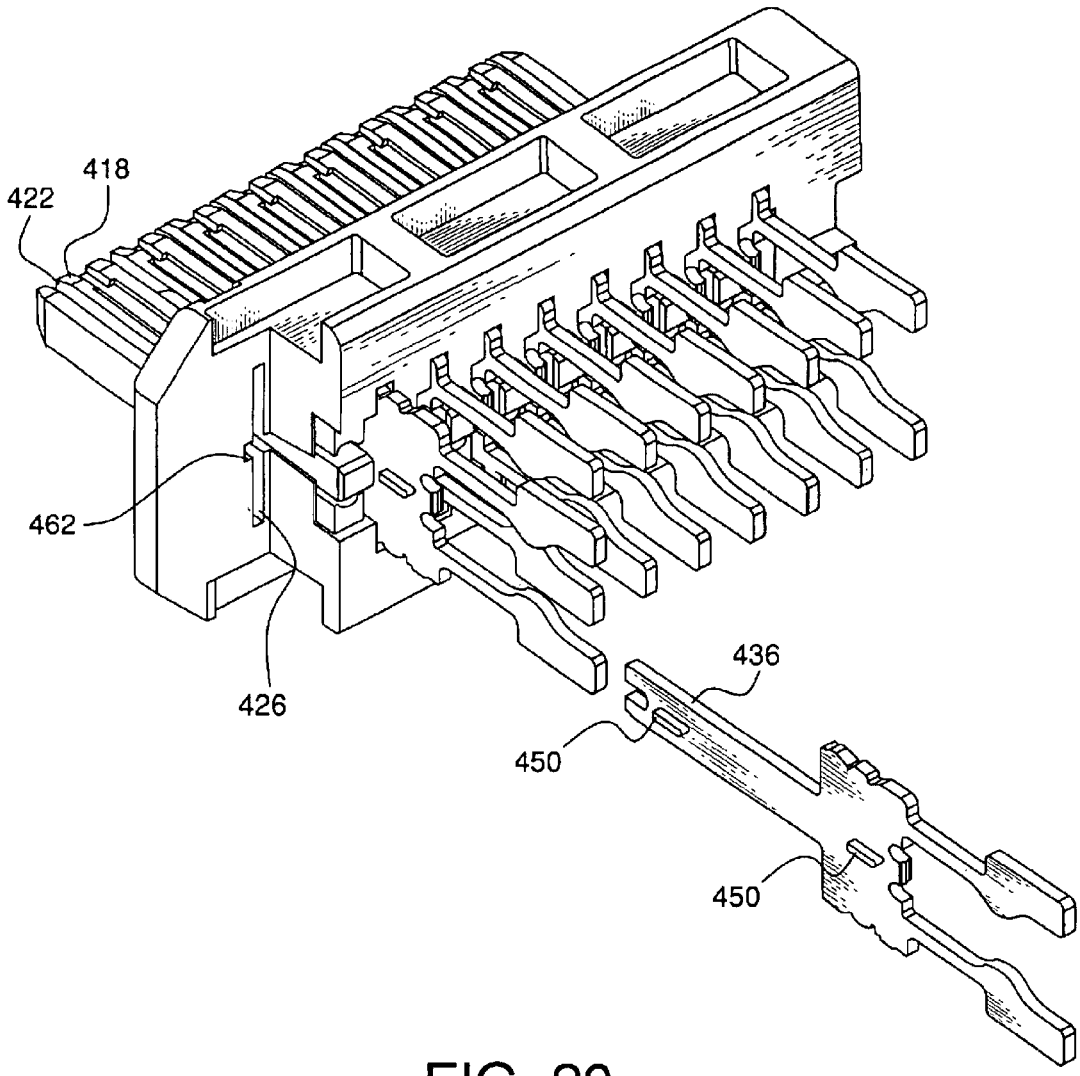
FIG. 20 is a perspective rear view, partially in section, of an exemplary plug housing with an exemplary ground contact aligned for insertion.

FIG. 19 provides a view of the rear of plug housing 410. FIG. 20 provides a view of the rear of plug housing 410 partially in section. As shown, body 416 has slots or conduits 426 formed therein. Conduits 426 align with gaps 422 formed between beams 418 extending from the opposing side of body 416. Accordingly, ground contacts 414 may be inserted into conduits 426 and elongated contact section 436 extend into the gaps 422 formed between beams 418. Conduits 426 have channels 462 formed therein which extend into the eternal sides of beams 418 facing gaps 422. Channels 462 accept projections 450 extending from ground contacts 414 and thereby secure ground contacts 414 into place within plug housing 410 during insertion and afterwards.

Figure 21:
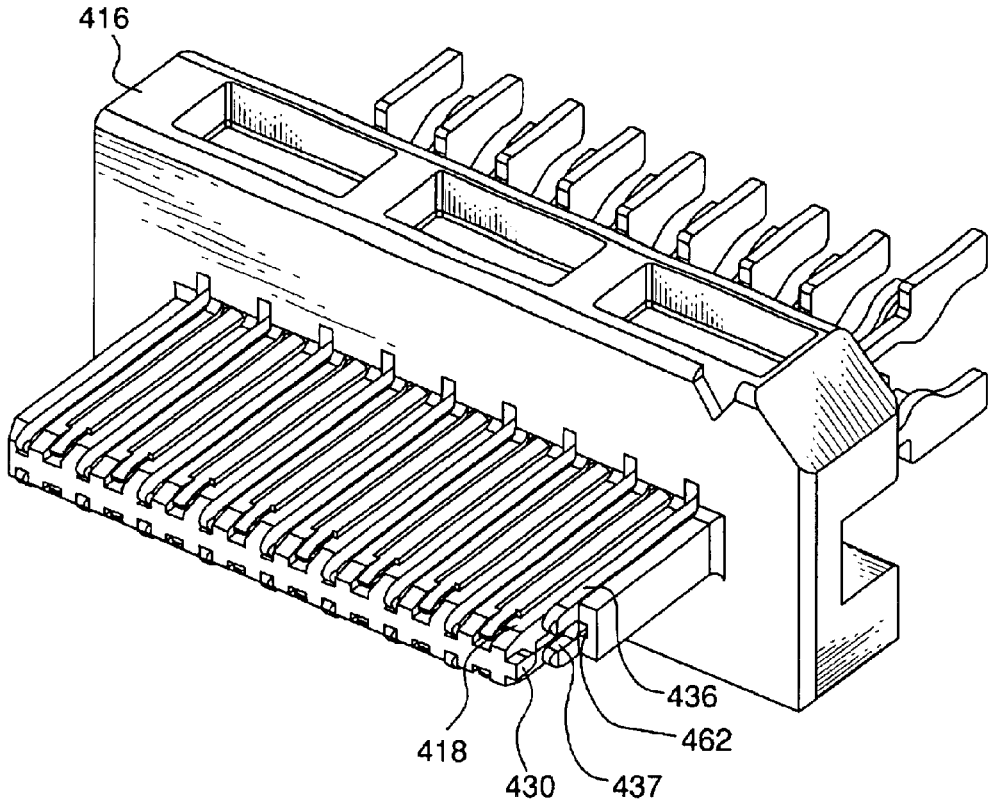
FIG. 21 is a perspective front view, partially in section, of an exemplary plug housing with an exemplary ground contact partially inserted therein.
Figure 22:
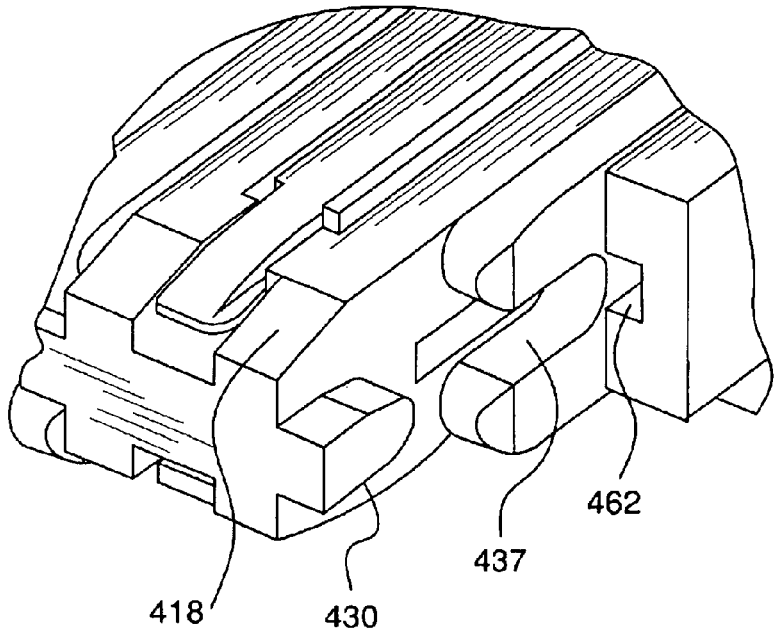
FIG. 22 is a detailed front view, partially in section, of an exemplary plug housing with an exemplary ground contact partially inserted therein.

FIGS. 21 and 22 provide a front view of plug housing 410 with a beam 418 shown partially in section. As shown, channel 462 extends along beam 418 in gap 422 between beams. Also, notch 437 in ground contact 414 has a profile corresponding to and designed to engage nose member 430. When ground contact 414 is fully inserted into plug housing 410, notch 437 engages nose member 430 thereby securing the distal end of contact 414 in place.

Figure 23:
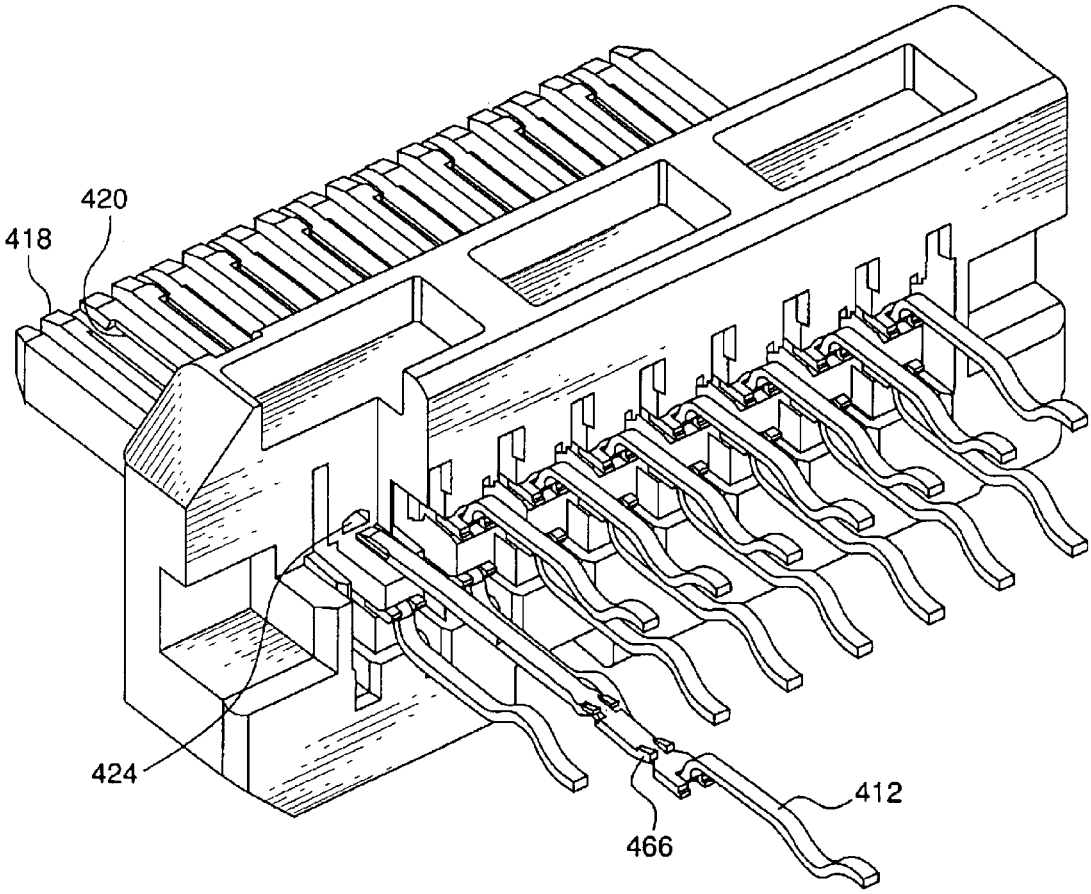
FIG. 23 is a perspective rear view, partially in section, of an exemplary plug housing with an exemplary signal contact aligned for insertion.

FIG. 23 provides a view of the rear of plug housing 410 partially in section. As shown, housing body 416 has conduits 424 formed therein for receiving signal contacts 412. Conduits 424 align with beams 418, and specifically troughs 420 formed in beams 418. Contacts 412 are inserted into conduits 424 and extend into troughs 420.

Figure 24:
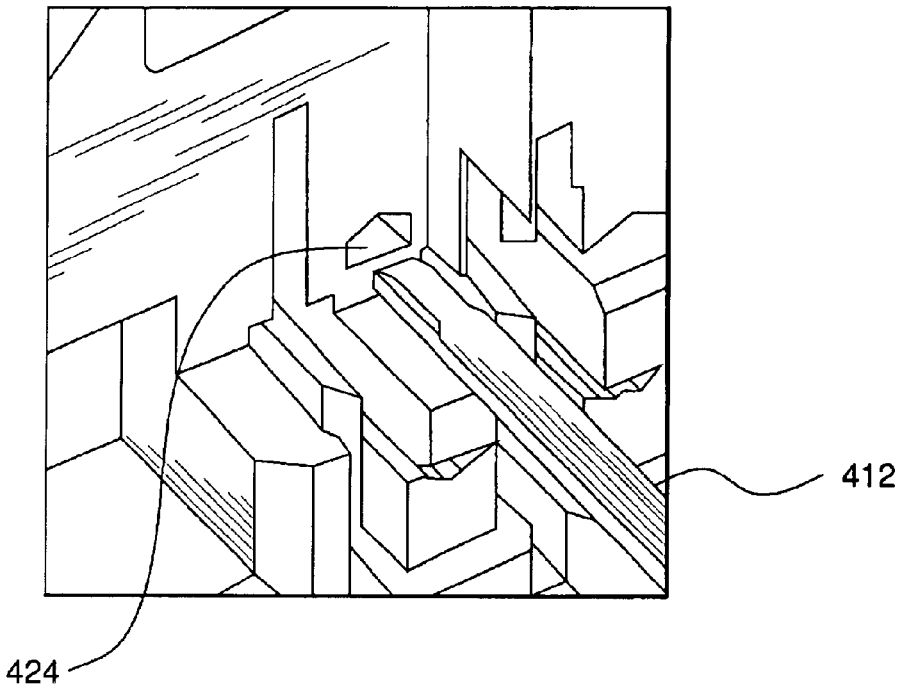
FIG. 24 is a detailed rear view, partially in section, of a signal contact aligned for insertion into an exemplary plug housing.
Figure 25:
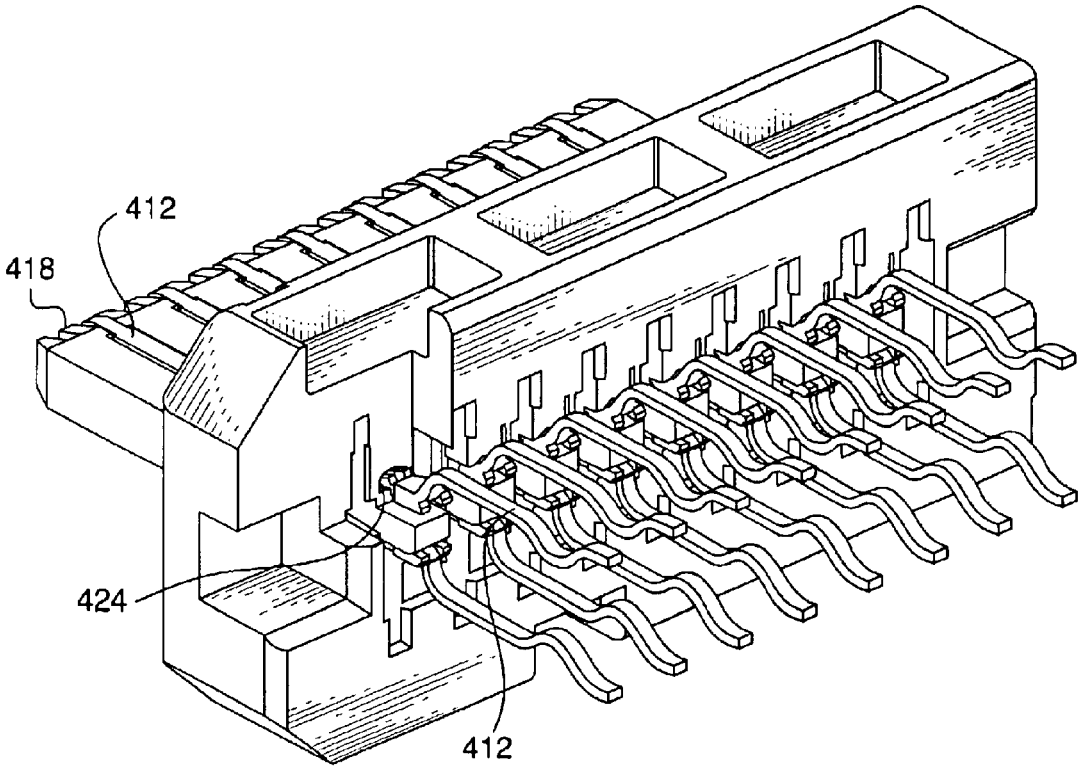
FIG. 25 is a perspective rear view, partially in section, of an exemplary plug housing with contact signals inserted therein.
Figure 26:
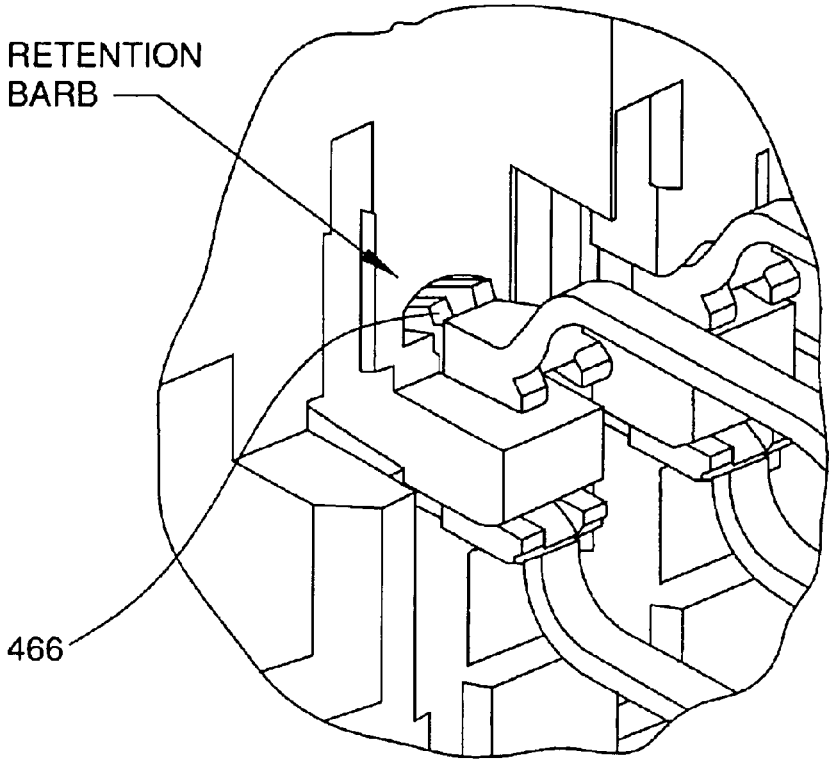
FIG. 26 is a detailed rear view, partially in section, of a signal contact fully inserted into an exemplary plug housing.

FIG. 24 provides an enlarged view of an opening for conduit 424. In the disclosed embodiment, the opening of conduit 424 has four sides, three of which are straight and a fourth which is arcuate in shape. Those skilled in the art recognize that other shapes may be used. The form factor of the opening of conduit 424 is larger than the form factor of the portion of contact 412 that is inserted into and through the opening. For example, the height of the opening of conduit 424 is greater than that of the portion of contact 414 that is inserted therein. This difference in height prevents conduit 424 from frictionally disturbing the contact portion of signal contact 412. As shown in FIGS. 25 and 26, however, a portion of signal contact 412, referred to herein as a retention barb 466, has a form factor greater than the opening to conduit 424. Accordingly, barb section 466 and contact 412 are secured frictionally in plug housing 410.

Figure 27:
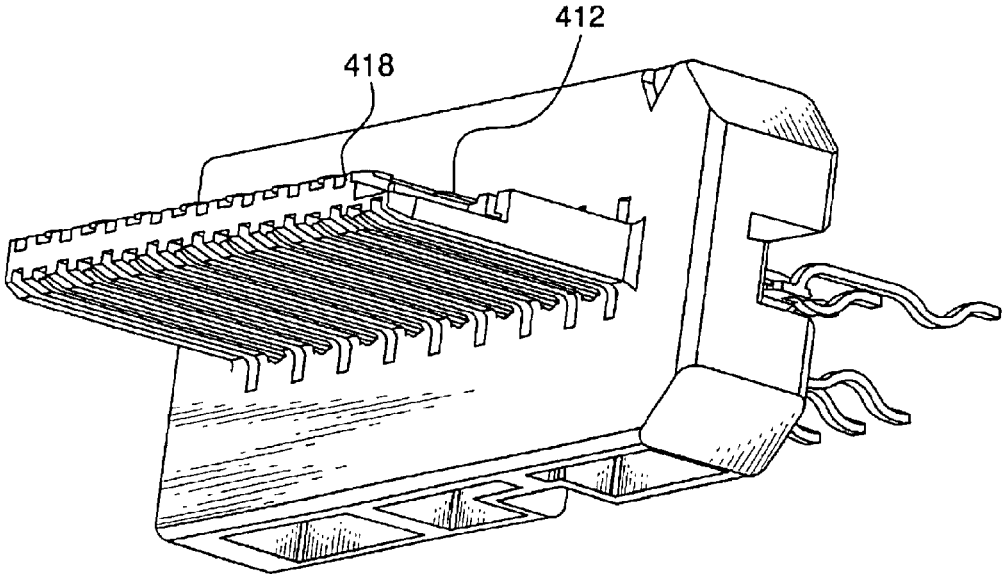
FIG. 27 is a front perspective view, partially in section, of a signal contact partially inserted into an exemplary plug housing.
Figure 28:
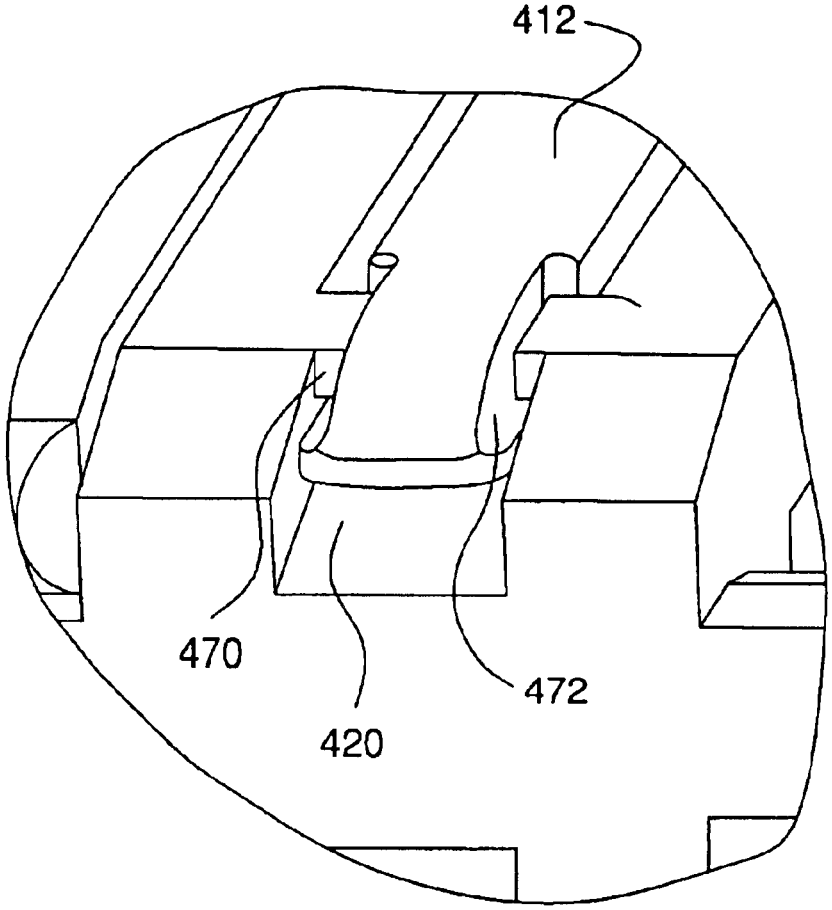
FIG. 28 is a detailed view of a signal contact inserted into a trough formed in an exemplary beam.
Figure 29:
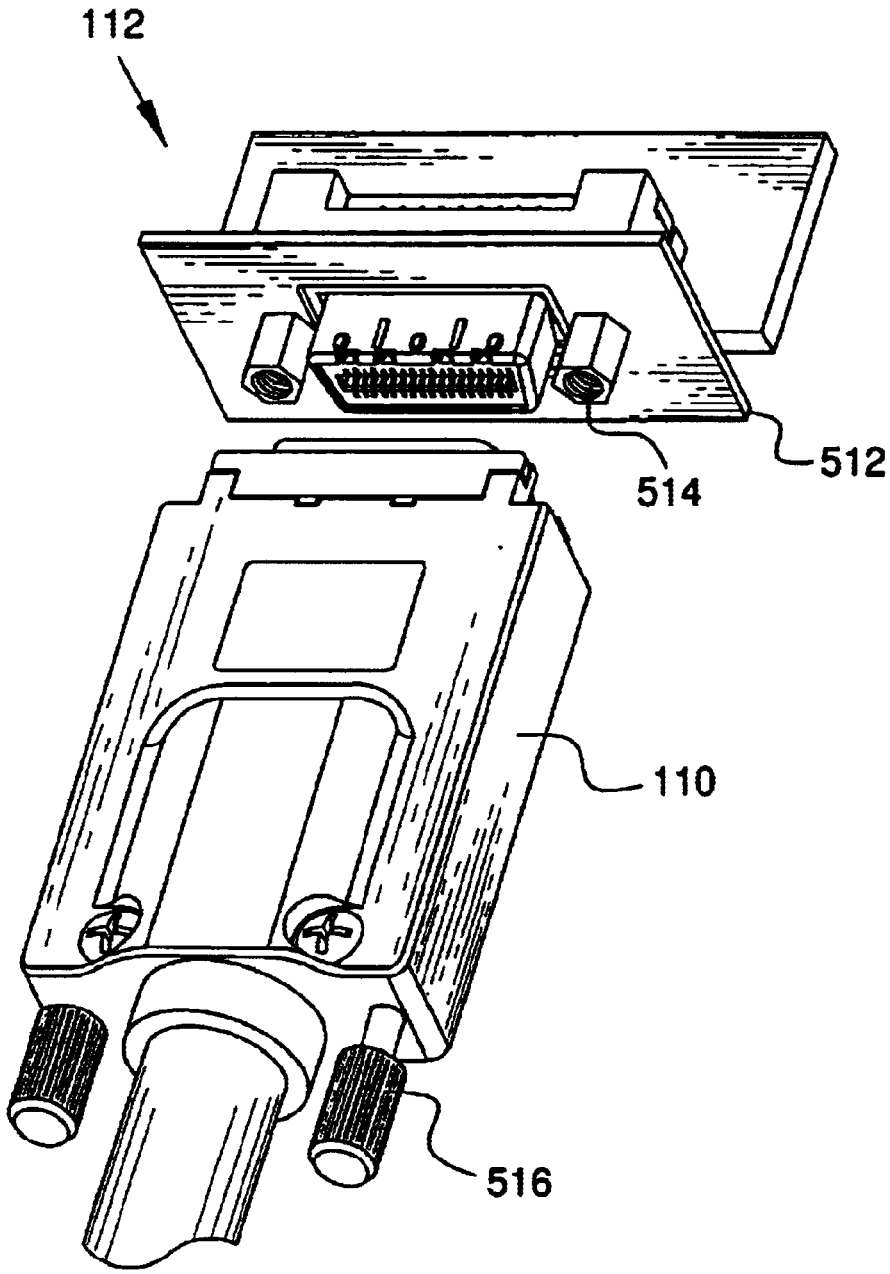
Figure 30:
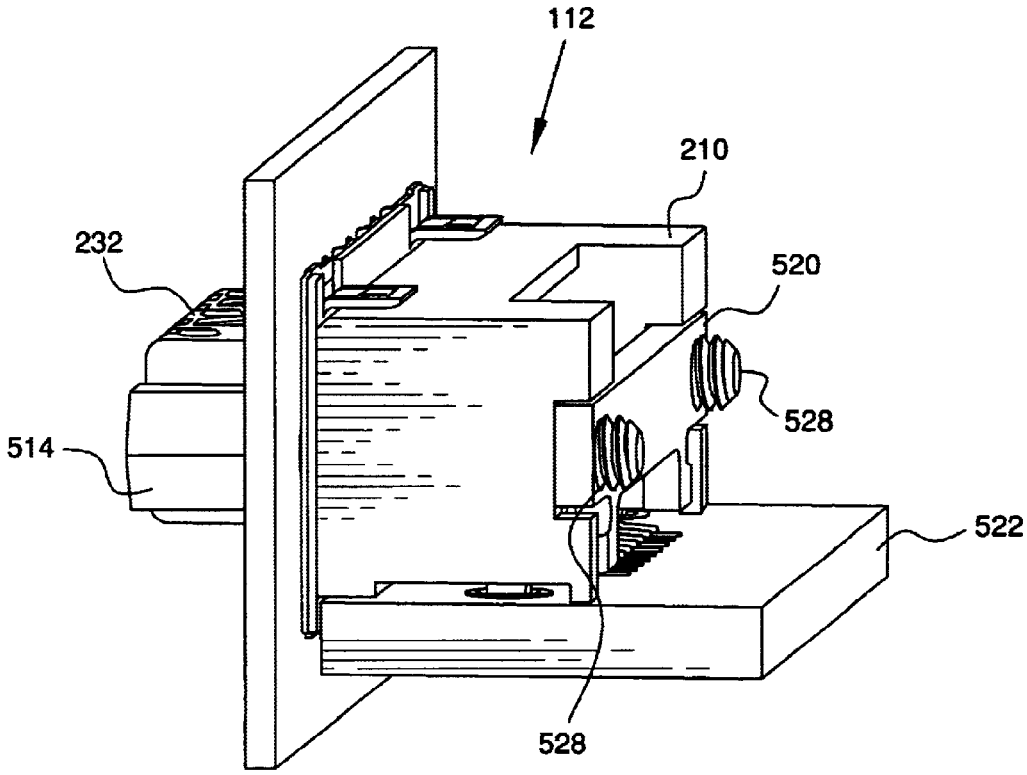
Figure 31:
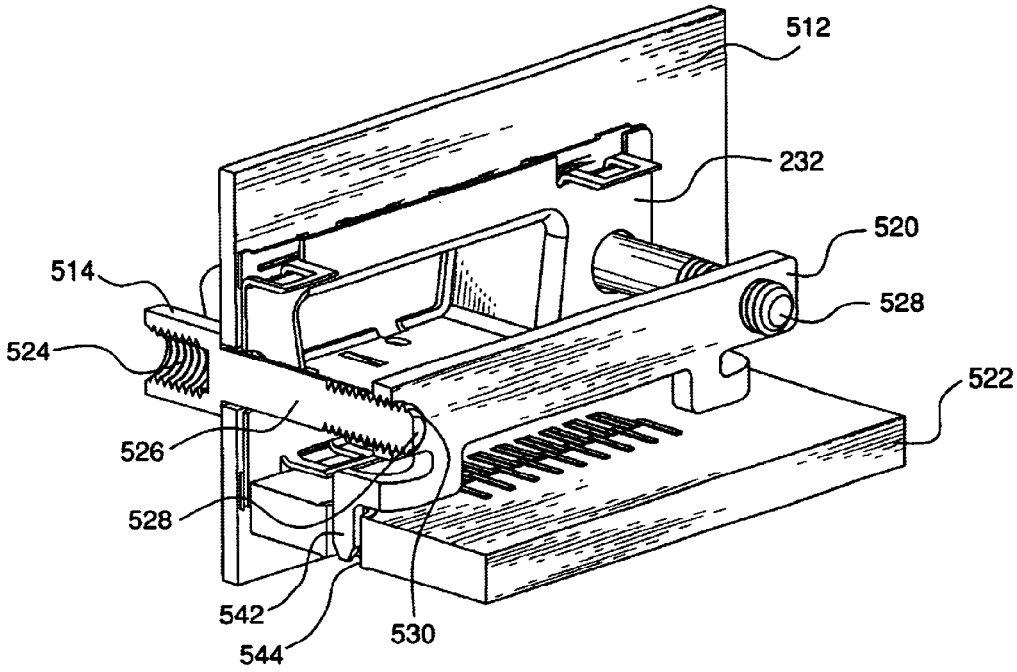
Figure 32:
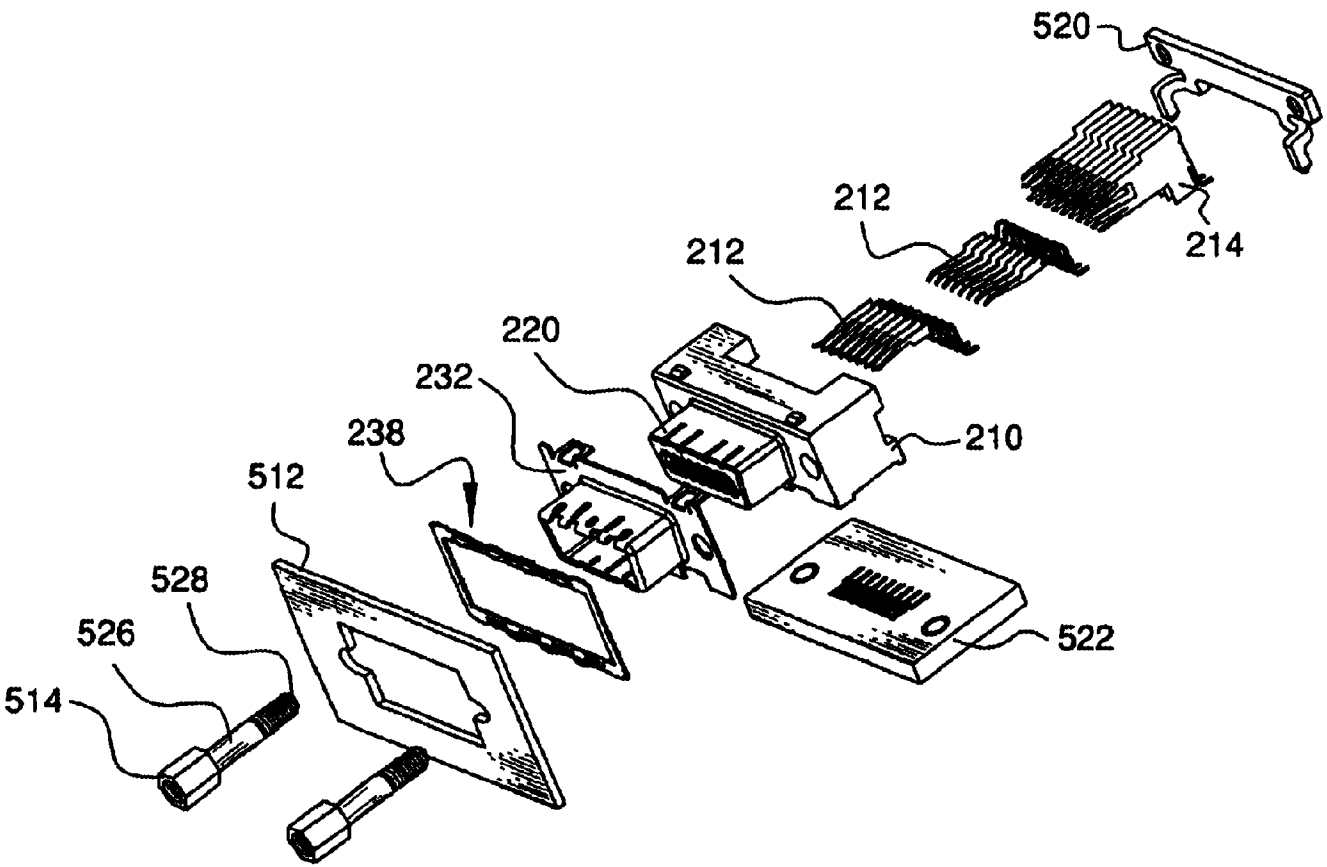
Figure 33:
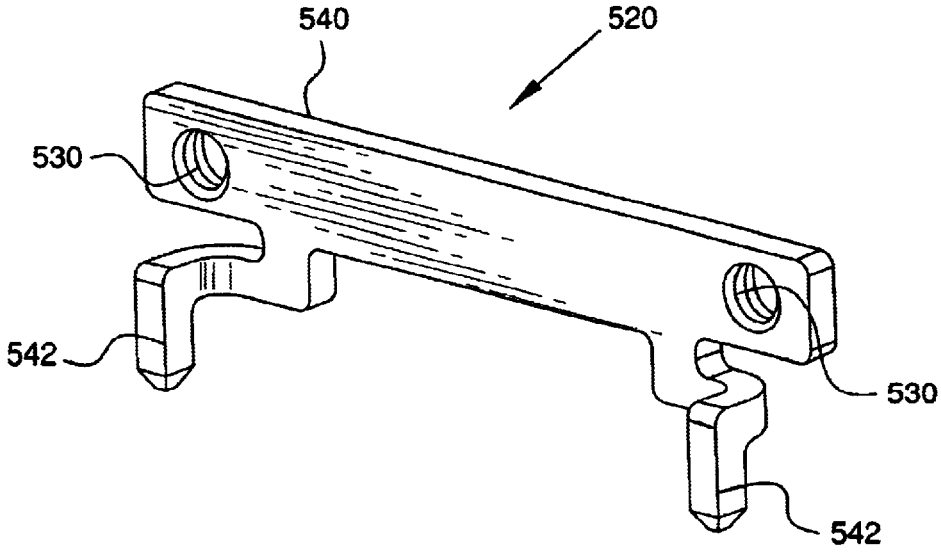

FIG. 27 provides a view of the front of plug housing 410. A portion of a beam 418 is shown in section so as to better illustrate signal contact 412 in trough 420. Also illustrated is projection 470 which extends from beam 428 into trough 420. FIG. 28 provides an enlarged view of a signal contact 412 fully inserted in trough 420. As shown, signal contact 412 has recesses or notches 472 formed therein. Projections 470 are located in notches 472 and thereby secure signal contact 412, and especially its distal end in place.

Thus, an exemplary plug and receptacle have been disclosed. The exemplary devices have been especially designed to optimize electrical performance and can be consistently and practically manufactured. A plug and receptacle in accordance with the exemplary disclosed embodiments are ideal for use in Infiniband connection systems but may be used with other architectures or standards as well.

Modifications may be made to the above-described embodiments without departing from the spirit or essential attributes thereof. For example, the shape of the conduits formed through the plug housing may be different than that described above. Likewise, the contacts may be formed in shapes different than those illustrated herein. Indeed numerous variations may be made upon the disclosed embodiments. Accordingly, the present invention should not be limited to any single embodiment, but rather construed in breadth and scope in accordance with the recitation of the appended claims.

What is claimed:

1. A plug, comprising:

at least one contact having a notch formed at a distal end;

housing for receiving said at least one contact, said housing comprising a body, a plurality of beams extending therefrom with gaps formed therebetween for receiving said at least one contact, and a member spanning said plurality of beams proximate distal ends of said beams, wherein for said at least one contact, said notch engages at least a portion of said member.

2. The plug of claim 1, wherein said member has a profile corresponding to said notch and said member is disposed in said notch.

3. The plug of claim 1, wherein said at least one contact is a ground contact.

4. The plug of claim 1, wherein said at least one contact further comprises at least one projection, said at least one projection situated in a channel formed in a side of one of the plurality of beams.

5. The plug of claim 4, wherein said channel extends into said body of said plug housing.

6. A plug, comprising:

at least one contact having at least one notch formed therein; and a housing for receiving said at least one contact, said housing comprising a body and a plurality of beams extending therefrom, at least one of said plurality of beams having formed therein a trough having at least one projection extending into said trough, wherein said trough has said at least one contact therein with said projection disposed in said notch.

7. The plug of claim 6, wherein said at least one contact has a notch formed at a distal end.

8. The plug of claim 6, wherein said at least one contact has two notches formed at a distal end, and said trough has two projections extending into said trough, said two projections disposed in said two notches.

9. The plug of claim 6, wherein said contacts are signal contacts.

10. A plug, comprising:

at least one contact having a first portion with a first form factor and a second portion with a second form factor; and a housing for receiving said at least one contact, said housing comprising a body and a plurality of beams extending therefrom, said body having at least one conduit formed therein extending between an opening in said body and aligned with at least one of said plurality of beams, wherein said at least one contact extends through said at least one conduit and along at least one of said plurality of beams, and for said at least one contact said first portion has a form factor smaller than said at least one conduit and said second portion has a form factor larger than said at least one conduit, said second portion abutting said body at the opening of said at least one conduit.

11. The plug of claim 10, wherein said at least one conduit has a first height and said second portion of said at least one contact has a second height said second height being greater than said first height.

12. The plug of claim 10, wherein said opening has a first width and said second portion of said at least one contact has a second width, said second width being greater than said first width.

13. The plug of claim 10, wherein said at least one conduit has three sides that are straight and a fourth side that is arcuate in shape.

14. The plug of claim 10, wherein at least one of said plurality of beams has a trough formed therein and a projection formed in said trough and said projection is disposed in a notch formed in said at least one contact.

15. A plug, comprising:

at least one contact, said at least one contact having at least one projection extending therefrom; and a housing for receiving said at least one contact, said housing comprising a body with at least one conduit formed therein for receiving said at least one contact and a plurality of beams extending from said body with at least one gap formed therebetween for receiving said at least one contact, said at least one conduit aligning with said at least one gap, and said at least one conduit and at least one of said plurality of beams having a channel formed therein, wherein for said at least one contact, said projection aligns with and is disposed in said channel.

16. The plug of claim 15, wherein said at least one contact comprises an extended contact section and a body section, said extended contact section and said body section each having a projection thereon aligning with and disposed in one of said channels.

17. The plug of claim 15, wherein said at least one contact has a notch formed therein, said notch engaging a member spanning said plurality of beams.

18. The plug of claim 17, wherein for said at least one contact, said member is disposed in said notch.

19. An electrical contact for insertion into a housing, comprising:

a body, said body having a first surface for forming an interference fit with the housing, and having a second surface opposite said first surface for forming an interference fit with the housing;

an elongated contact extending from said body;

a first armature extending from said body and separated from said elongated contact by said body, said first armature having a surface aligned with said first surface; and a second armature extending from said body and separated from said elongated contact by said body, said armature having a surface aligned with said second surface.

20. The electrical contact of claim 19, wherein said first armature further comprises a first contact, and said second armature further comprise a second contact.

21. The electrical contact of claim 19, wherein at least one of said first and second surface has retention barbs formed therein.

22. The electrical contact of claim 19, further comprising at least one projection for being situated in a channel formed in the housing.

23. The electrical contact of claim 19, wherein said elongated contact has a recess formed therein proximate a distal end.

* * * * *